US010621903B2

(12) United States Patent
Yamamoto

(10) Patent No.: US 10,621,903 B2
(45) Date of Patent: Apr. 14, 2020

(54) DISPLAY DEVICE, IMAGE PROCESSING DEVICE, AND METHOD OF IMAGE PROCESSING

(71) Applicant: SHARP KABUSHIKI KAISHA, Sakai (JP)

(72) Inventor: Shinji Yamamoto, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/261,967

(22) Filed: Jan. 30, 2019

(65) Prior Publication Data

US 2019/0237000 A1 Aug. 1, 2019

(30) Foreign Application Priority Data

Jan. 31, 2018 (JP) ..... 2018-015212

(51) Int. Cl.
*G09G 3/20* (2006.01)
*G09G 3/36* (2006.01)

(52) U.S. Cl.
CPC ..... *G09G 3/2007* (2013.01); *G09G 3/36* (2013.01); *G09G 2320/0271* (2013.01)

(58) Field of Classification Search
CPC ..... G09G 3/2007; G09G 3/36; G09G 2320/0271; G09G 2320/0653; G09G 2320/066; G09G 2354/00; G09G 3/3413; G09G 3/3607; G09G 5/10; G09G 2300/0452; G09G 2320/0626; G09G 2320/0646; G09G 2360/144
See application file for complete search history.

(56) References Cited

U.S. PATENT DOCUMENTS

2014/0092117 A1* 4/2014 Yoshimura ..... G09G 5/02 345/589
2018/0005560 A1* 1/2018 Itakura ..... G09G 3/20

FOREIGN PATENT DOCUMENTS

JP 2009-301323 A 12/2009

* cited by examiner

*Primary Examiner* — Nelson M Rosario
(74) *Attorney, Agent, or Firm* — ScienBiziP, P.C.

(57) ABSTRACT

A smartphone in accordance with an embodiment of the present invention includes a control section capable of generating an output image by adjusting a gradation value of each pixel of an input image with use of specialized gradation change characteristics. In the specialized gradation change characteristics, (i) a gradation change rate is substantially constant in a low gradation region and a high gradation region, (ii) in a first side of an intermediate gradation region selected from (a) a low-gradation-region side and (b) a high-gradation-region side, the gradation change rate is lower than in the low gradation region and lower than in the high gradation region, and (iii) in a second side of the intermediate gradation region selected from (a) the low-gradation-region side and (b) the high-gradation-region side, the second side differing from the first side, the gradation change rate is higher than in the low gradation region and higher than in the high gradation region.

9 Claims, 13 Drawing Sheets

DISPLAY DEVICE, IMAGE PROCESSING DEVICE, AND METHOD OF IMAGE PROCESSING

This Nonprovisional application claims priority under 35 U.S.C. § 119 on Patent Application No. 2018-015212 filed in Japan on Jan. 31, 2018, the entire contents of which are hereby incorporated by reference.

TECHNICAL FIELD

An aspect of the present invention relates to a display device.

BACKGROUND ART

Various techniques have been proposed for improving viewability of a display screen displayed by a display device. As one example, Patent Literature 1 discloses a display device which (i) estimates a user's age and then (ii) in a case where it is determined that the user is an elderly person, changes a manner in which a screen is displayed.

CITATION LIST

Patent Literature

[Patent Literature 1]
Japanese Patent Application Publication, Tokukai, No. 2009-301323

SUMMARY OF INVENTION

Technical Problem

However, there is still room for improving the specific manner of achieving a display screen having excellent viewability for elderly people. An object of an aspect of the present invention is to provide a display screen which, compared to a conventional display screen, has superior viewability for elderly people.

Solution to Problem

In order to solve the above problem, a display device in accordance with an aspect of the present invention includes: a control device capable of generating an output image by adjusting an input image; and a display section configured to display the output image, the control device being capable of generating the output image by adjusting a gradation value of each pixel of the input image with use of specialized gradation change characteristics, wherein assuming that: a gradation value of one pixel of the input image is considered to be an input gradation value; a gradation value of one pixel of the output image, which one pixel corresponds to the one pixel of the input image, is considered to be an output gradation value; in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are: (i) the gradation change rate is substantially constant in the low gradation region and in the high gradation region; (ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

In order to solve the above problem, an image processing device in accordance with an aspect of the present invention is an image processing device capable of generating an output image by adjusting an input image, including: an adjustment section configured to generate the output image by adjusting a gradation value of each pixel of the input image with use of specialized gradation change characteristics, wherein assuming that: a gradation value of one pixel of the input image is considered to be an input gradation value; a gradation value of one pixel of the output image, which one pixel corresponds to the one pixel of the input image, is considered to be an output gradation value; in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are: (i) the gradation change rate is substantially constant in the low gradation region and in the high gradation region; (ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

In order to solve the above problem, a method of image processing in accordance with an aspect of the present invention is a method of image processing in which an output image is generated by adjustment of an input image, the method including the step of: adjusting a gradation value of each pixel of the input image with use of specialized gradation change characteristics so as to generate the output image, wherein assuming that: a gradation value of one pixel of the input image is considered to be an input gradation value; a gradation value of one pixel of the output image, which one pixel corresponds to the one pixel of the input image, is considered to be an output gradation value; in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are: (i) the gradation change rate is substantially constant in the low gradation region and in the high gradation region; (ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

Advantageous Effects of Invention

A display device in accordance with an aspect of the present invention makes it possible to provide a display screen which, compared to a conventional display screen, has superior viewability for elderly people. An image processing device in accordance with an aspect of the present invention and a method of image processing in accordance with an aspect of the present invention also bring about a similar effect.

DESCRIPTION OF EMBODIMENTS

Embodiment 1

The following description will discuss Embodiment 1. For convenience, in subsequent embodiments, members similar in function to those described in Embodiment 1 will be given the same reference signs, and their description will be omitted.

(Overview of Smartphone 1)

Figure 1:
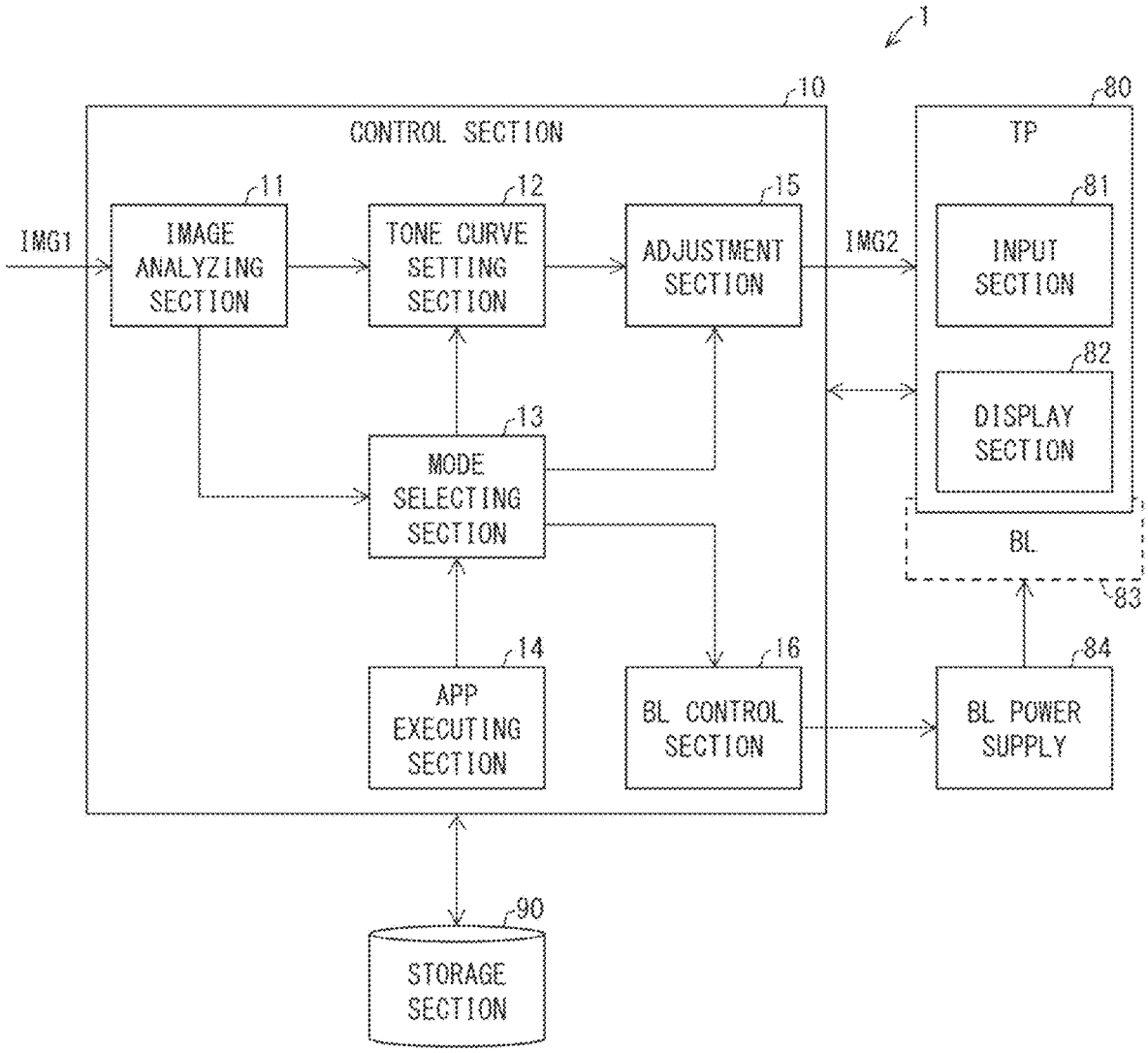
FIG. 1 is a functional block diagram illustrating a configuration of main parts of a smartphone in accordance with Embodiment 1.

FIG. 1 is a functional block diagram illustrating a configuration of main parts of a smartphone 1 (display device) in accordance with Embodiment 1. The smartphone 1 is an example of a portable display device. Note, however, that a display device in accordance with an aspect of the present invention may alternatively be a stationary display device, such as a television or a desktop computer.

The smartphone 1 includes a control section 10 (control device, image processing device), a touch panel (TP) 80, a backlight (BL) 83, a BL power supply 84, and a storage section 90. The TP 80 includes an input section 81 and a display section 82 which are provided integrally with each other. One possible example of the input section 81 is a known touch sensor. One possible example of the display section 82 is a liquid crystal panel. Note that the input section 81 and the display section 82 may alternatively be provided in a non-integral manner.

The control section 10 controls various sections of the smartphone 1. In Embodiment 1, the control section 10 also serves as a display control section which controls the display section 82. FIG. 1 illustrates an example configuration in which the control section 10 and the display section 82 are both singular in number. Note, however, that the control section 10 and/or the display section 82 may be plural in number.

A vertical direction (up and down direction) and a horizontal direction (left and right direction) of the display section 82 are determined in advance. The display section 82 has a plurality of pixels (display elements) which are provided along the vertical direction and the horizontal direction. In other words, the display section 82 has a plurality of pixels provided in a matrix arrangement.

The BL 83 illuminates the TP 80 (more specifically, the display section 82) with, for example, white light. The BL 83 includes a plurality of light sources. The light sources of the BL 83 are, for example, light emitting diodes (LEDs). The BL 83 is provided rearward of the TP 80 (i.e., on a side away from a display surface of the TP 80) in a manner so as to positionally overlap with the TP 80. Note that in FIG. 1, for convenience, the overlapping of the TP 80 and the BL 83 is not depicted accurately.

The BL power supply 84 drives the light sources of the BL 83. In one example, emission intensity (e.g., luminance) of a light-emitting surface of the BL 83 (a surface of the BL 83 which faces a rear surface of the TP 80) is controlled by controlling electric current supplied to the light sources by the BL power supply 84. Such control can be carried out by, for example, a BL control section 16 (described later). Illuminating the TP 80 with use of the BL 83 makes it possible for the plurality of pixels to form an image on the display surface (display area) of the TP 80. In other words, such illumination makes it possible to display a desired image in the display area.

(Adjustment of Input Image with Use of Tone Curve)

The control section 10 includes an image analyzing section 11, a tone curve setting section 12, a mode selecting section 13, an app executing section 14, an adjustment section 15, and the BL control section 16. The term "app" as used herein refers to an application (application software) which can be executed on the smartphone 1. Operations of the various sections of the control section 10 will be described later.

The control section 10 obtains an IMG1 (input image) from an external source. For example, the IMG1 can be an image (image data) stored in video random access memory (VRAM; not illustrated) in the smartphone 1. The control section 10 processes the IMG1 so as to generate an IMG2 (output image)

The control section 10 generates the IMG2 by carrying out various image processing for improving the viewability of the IMG1. The control section 10 then supplies the IMG2 to the display section 82. In this way, the control section 10 can cause the display section 82 to display an image. Embodiment 1 mainly discusses an example case in which the control section 10 generates the IMG2 by using a tone curve (described later) to adjust a gradation value of each pixel of the IMG1.

Hereinafter, the action "use a tone curve to adjust a gradation value of each pixel of the IMG1" may be simply worded as, for example, "use a tone curve to adjust gradation values of the IMG1," or "use a tone curve to adjust the IMG1". The "gradation value of each pixel of the IMG1" may be simply worded as "gradation values of the IMG1". Similar wording may be used with regard to IMG2.

Herein, a gradation value of a single pixel of the IMG1 is referred to as "x" (input gradation value). Furthermore, a gradation value of a single pixel of the IMG2, which pixel corresponds to the single pixel of the IMG1, is referred to as "y" (output gradation value). The control section 10 can generate the IMG2 by using a tone curve to adjust the gradation value of each pixel of the IMG1. The tone curve is a function ($y=f(x)$) expressing a correlation between x and y. The tone curve may be referred to as gradation change characteristics.

The present specification discusses an example case in which x and y are normalized gradation values. In other words, in both the IMG1 and the IMG2, 0 is a minimum gradation value, and 1 is a maximum gradation value. As such, x satisfies $0 \leq x \leq 1$, and y satisfies $0 \leq y \leq 1$. The gradation value is an index representing luminance (brightness) of a pixel. Specifically, a larger gradation value (a gradation value closer to 1) represents a higher luminance of a pixel. Likewise, a smaller gradation value (a gradation value closer to 0) represents a lower luminance of a pixel.

Each tone curve described herein passes through two points, specifically where $(x, y)=(0, 0)$ and where $(x, y)=(1, 1)$. Furthermore, each tone curve described herein is a continuous function for all values of x.

Prior to normalization, a gradation value is expressed as a digital value of any number of bits (N bits, where N is an integer). One example is N=8. As such, x and y represent discrete numbers whose values increase by a predetermined value (for example, $1/2^N$).

In the present specification, in the function $y=f(x)$, a rate of change of y with respect to x is referred to as a "gradation change rate" (hereinafter also referred to as "V"). V can be mathematically expressed as follows: $V=dy/dx=d\{f(x)\}/dx$. As one example, consider a case where x has changed from x to $(x+\Delta x)$ and y has changed from y to $(y+\Delta y)$. $\Delta x$ is a very small amount. For example, $\Delta x$ may be $1/2N$. In the smartphone 1, the gradation change rate may be calculated as $V=\Delta y/\Delta x$.

In the present specification, the x axis of a graph of $y=f(x)$ is referred to as a "gradation region of input image" (hereinafter also referred to as simply "gradation region"). The gradation region represents possible gradation values of each pixel of the input image. In the present specification, the gradation region is discussed as being divided into three regions: a low gradation region, an intermediate gradation region, and a high gradation region.

The low gradation region refers to a part of the gradation region in which the value of x is small. The high gradation region refers to a part of the gradation region in which the value of x is large. The intermediate gradation region can therefore be defined as a remaining part of the gradation obtained when the low gradation region and the high gradation region are excluded.

Consider a case in which numbers "a" and "b," selected arbitrarily, satisfy the following: $0<a<b<1$. In such a case, the regions can be defined as follows:

Low gradation region: region expressed by $0 \leq x < a$.

Intermediate gradation region: region expressed by $a \leq x \leq b$.

High gradation region: region expressed by $b < x 1$. The values of "a" and "b" may be set as appropriate by a designer of the smartphone 1. As one example, "a" may be set to a value of not more than 0.2, and "b" may be set to a value of not less than 0.9. Note that these numerical values are merely one possible example.

A side of the intermediate gradation region which is closer to the low gradation region than it is the high gradation region may be referred to as a "low-gradation-region side of the intermediate gradation region". As one example, the low-gradation-region side of the intermediate gradation region can be defined as a region expressed by $a \leq x < (a+b)/2$.

Conversely, a side of the intermediate gradation region which is closer to the high gradation region than it is the low gradation region may be referred to as a "high-gradation-region side of the intermediate gradation region". As one example, the high-gradation-region side of the intermediate gradation region can be defined as a region expressed by $(a+b)/2 < x \leq b$.

(Conventional Tone Curve)

Figure 2:
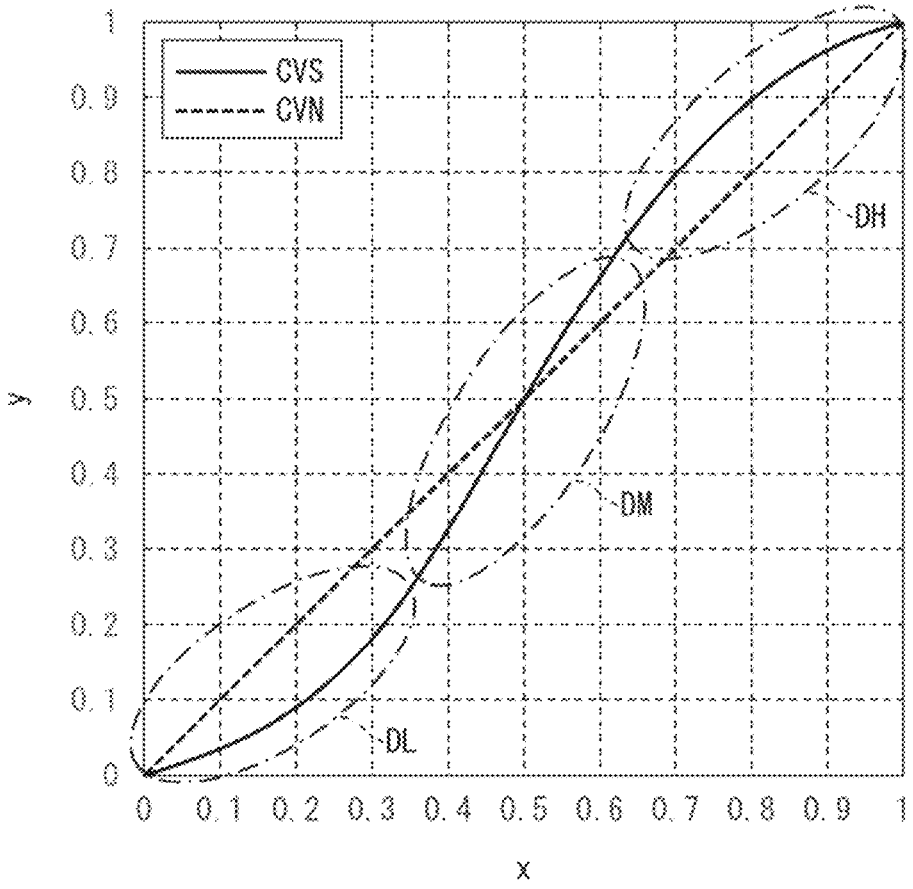
FIG. 2 is a diagram for explaining a conventional tone curve.

FIG. 2 is a diagram (graph) for explaining a conventional tone curve. FIG. 2 illustrates two types of tone curves: a normal tone curve (CVN) and an S-shaped tone curve (CVS). The normal tone curve represents a relation where $y=x$. Hereinafter, the normal tone curve may also be expressed as "$y=fN(x)$".

In a case where gradation values (x) of IMG1 are adjusted with use of the normal tone curve, each gradation value (y) of the IMG2 will be equal to a corresponding gradation value of the IMG1. In other words, the normal tone curve is equivalent to image processing in which the gradation values of the IMG1 are left unchanged (i.e., are maintained). In the normal tone curve, for all values of x, V=1.

The S-shaped tone curve is an example of a tone curve disclosed in Patent Literature 1. Hereinafter, the S-shaped tone curve may also be expressed as "$y=fS(x)$". The S-shaped tone curve can be expressed by, for example, a function representing a known cubic polynomial expression (i.e., expressed by a cubic function). The following description will discuss a shape of the S-shaped tone curve.

In the low gradation region, the S-shaped tone curve is curved so as to form a downwardly convex shape. As such, in the low gradation region, except for a case where x=0, the S-shaped tone curve satisfies $fN(x)>fS(x)$ (see region DL in FIG. 2). In the low gradation region of the S-shaped tone curve, V increases as x increases.

In the intermediate gradation region, the S-shaped tone curve has a nearly rectilinear shape in which y increases monotonically as x increases. That is, in the intermediate gradation region of the S-shaped tone curve, V can be considered to be substantially constant. As such, in the low-gradation-region side of the intermediate gradation region, the S-shaped tone curve satisfies $fN(x)>fS(x)$, and in the high-gradation-region side of the intermediate gradation region, the S-shaped tone curve satisfies $fN(x)<fS(x)$ (see region DM in FIG. 2).

In this way, in the intermediate gradation region, a change occurs as to which one of $fN(x)$ and $fS(x)$ is larger than the other. In other words, the S-shaped tone curve is set such that in the intermediate gradation region, there is only one value of x for which $fN(x)=fS(x)$. In the example of FIG. 2, $fN(x)=fS(x)$ at $x=0.5$.

In the high gradation region, the S-shaped tone curve is curved so as to form an upwardly convex shape. As such, in the high gradation region, except for a case where x=1, the S-shaped tone curve satisfies $fN(x)<fS(x)$ (see region DH in FIG. 2). In the high gradation region of the S-shaped tone curve, V decreases as x increases.

In this way, the S-shaped tone curve is set as a function in which (i) in the low gradation region and the high gradation region, an increase in x correlates to a gradual increase in y, and (ii) in the intermediate gradation region, an increase in x correlates to a rapid increase in y.

In general, there tends to be greater color variation in a natural image (for example, image data for a photograph of natural scenery), as compared to a digitally-created image designed by a person (for example, a display screen for web contents). As such, in many cases, a natural image includes not only pixels having a low gradation value (low gradation pixels) and pixels having a high gradation value (high gradation pixels), but also a comparatively large number of pixels having an intermediate gradation value (intermediate gradation pixels).

Therefore, in a case where the IMG1 is a natural image, it is possible to effectively improve contrast in the intermediate gradation region of the IMG1 by using the S-shaped tone curve to adjust the gradation values of the IMG1. In this way, the shape of the S-shaped tone curve is set so as to be suited to improving contrast in a natural image.

(Specialized Tone Curve)

The inventor of the present invention (hereinafter, "the inventor") discovered that, depending on the type of the IMG1 (i.e., depending on the distribution of gradation values in the IMG1), using the S-shaped tone curve to adjust the gradation values of the IMG1 can, problematically, cause a decrease in the viewability of the image obtained after adjustment (i.e., the IMG2), as described later. In order to solve the above problem, the inventor novelly arrived at the idea of using a tone curve differing from the S-shaped tone curve to adjust the gradation values of the IMG1. The inventor arrived at a novel configuration of the smartphone 1 based on this idea.

Hereinafter, a tone curve in accordance with an aspect of the present invention (i.e., a tone curve at which the inventor novelly arrived) is referred to as a "specialized tone curve" (specialized gradation change characteristics). In a case where the IMG1 is an image other than a natural image (hereinafter, "non-natural image"), it is possible to effectively improve contrast in the IMG1 by using a specialized tone curve to adjust the gradation values of the IMG1. In particular, as described later, the specialized tone curve is suited to providing a display screen having excellent viewability for elderly people (senior users). As such, the specialized tone curve may also be called "a tone curve for elderly people."

Figure 3:
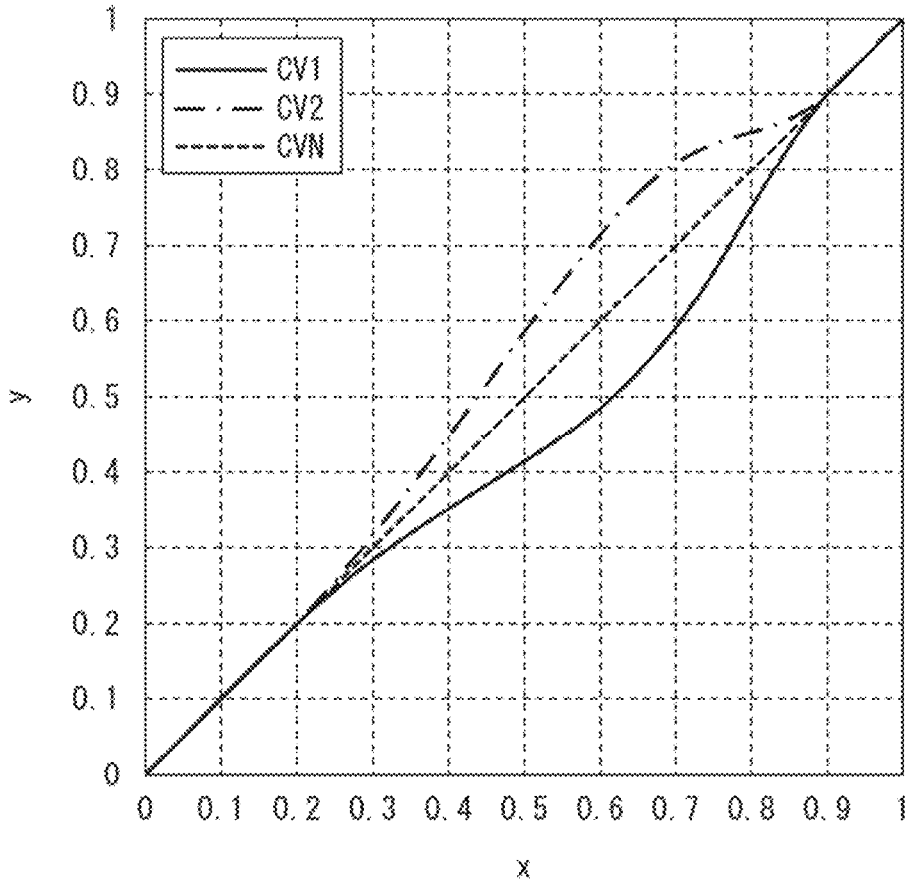
FIG. 3 is a diagram for explaining a specialized tone curve.

FIG. 3 is a diagram (graph) for explaining the specialized tone curve. FIG. 3 illustrates a first specialized tone curve (CV1) (first specialized gradation change characteristics) and a second specialized tone curve (CV2) (second specialized gradation change characteristics), each of which is an example of the specialized tone curve (specialized gradation change characteristics). FIG. 3 also shows a normal tone curve identical to that in FIG. 2, for the purposes of comparison with the specialized tone curve.

As will be discussed below, the specialized tone curve satisfies each of the following characteristics 1 to 3:

Characteristic 1: V is substantially constant in the low gradation region and the high gradation region.

Characteristic 2: In a first side of the intermediate gradation region selected from (a) the low-gradation-region side and (b) the high-gradation-region side, V is lower (smaller) than in the low gradation region and lower (smaller) than in the high gradation region.

Characteristic 3: In a second side of the intermediate gradation region selected from (a) the low-gradation-region side and (b) the high-gradation-region side, the second side differing from the first side, V is higher (greater) than in the low gradation region and higher (greater) than in the high gradation region.

As such, the specialized tone curve has a shape which differs significantly from that of the S-shaped tone curve in each of the low gradation region, the intermediate gradation region, and the high gradation region. In particular, the specialized tone curve is set such that a difference $(f(x)-x)$ between the specialized tone curve and the normal tone curve has an extreme value in the intermediate gradation region.

(First Specialized Tone Curve)

The first specialized tone curve is suited for adjustment of a bright display screen (i.e., an input image whose high gradation pixels are more predominant than the low gradation pixels and intermediate gradation pixels). As such, the first specialized tone curve may also be called "a bright tone curve for elderly people." Hereinafter, the first specialized tone curve illustrated in FIG. 3 may also be expressed as $y=f1(x)$.

As illustrated in FIG. 3, except for a case where $x=0$ and a case where $x=1$, the first specialized tone curve satisfies $f1(x)<x$. In the low gradation region and the high gradation region, the first specialized tone curve has a shape similar to that of the normal tone curve. In other words, in the low gradation region and high gradation region, the first specialized tone curve satisfies $f1(x)\approx x$. As such, in the low gradation region and the high gradation region, the first specialized tone curve satisfies $V\approx 1$. In this way, the first specialized tone curve satisfies the above Characteristic 1.

However, in the intermediate gradation region, the shape of the first specialized tone curve differs greatly from that of the normal tone curve. Specifically, the first specialized tone curve is set so as to move away from the normal tone curve particularly in the intermediate gradation region. Hereinafter, a difference between the first specialized tone curve and the normal tone curve is expressed as $d1(x)=f1(x)-x$. Note that $d1(x)$ may be also referred to as a first difference function.

More specifically, the first specialized tone curve is set so that $d1(x)$ has a minimum value in the intermediate gradation region. Hereinafter, an x value at which $d1(x)$ returns a minimum is referred to as $x=x1$. In the first specialized tone curve, V takes on a minimum value at $x=x1$.

As such, in the first specialized tone curve, V decreases in the low-gradation-region side of the intermediate gradation region, and V increases in the high-gradation-region side of the intermediate gradation region. The first specialized tone curve therefore satisfies the following characteristics 2A and 3A:

Characteristic 2A: In the low-gradation-region side of the intermediate gradation region, V is lower than in the low gradation region and lower than in the high gradation region.

Characteristic 3A: In the high-gradation-region side of the intermediate gradation region, V is higher than in the low gradation region and higher than in the high gradation region.

The Characteristics 2A and 3A are examples of the above Characteristics 2 and 3, respectively.

(Second Specialized Tone Curve)

The second specialized tone curve is suited for adjustment of a dark display screen (i.e., an input image whose low gradation pixels are more predominant than the high gradation pixels and intermediate gradation pixels). As such, the second specialized tone curve may also be called "a specialized dark tone curve (a dark tone curve for elderly people)." Hereinafter, the second specialized tone curve illustrated in FIG. 3 may also be expressed as y=f2 (x).

As illustrated in FIG. 3, f1(x) and f2(x) have symmetry with respect to normal tone curve. That is, f1(x) and f2(x) are set so as to satisfy $\frac{1}{2}\{f1(x)+f2(x)\}=x$. Except for a case where x=0 and a case where x=1, the second specialized tone curve satisfies f2(x)>x.

As with the first specialized tone curve, in the low gradation region and the high gradation region, the second specialized tone curve takes on values similar to those of the normal tone curve. In other words, in the low gradation region and high gradation region, the second specialized tone curve satisfies f2(x)≈x. As such, in the low gradation region and the high gradation region, the second specialized tone curve satisfies V≈1. In this way, the second specialized tone curve satisfies the above Characteristic 1.

Hereinafter, a difference between the second specialized tone curve and the normal tone curve is expressed as d2(x)=f2(x)−x. Note that d2(x) may be also referred to as a second difference function. The second specialized tone curve is set so that d2(x) has a maximum value in the intermediate gradation region. Hereinafter, an x value at which d2(x) returns a maximum is referred to as x=x2. In the second specialized tone curve, V takes on a maximum value at x=x2.

As such, in the second specialized tone curve, V increases in the low-gradation-region side of the intermediate gradation region, and V decreases in the high-gradation-region side of the intermediate gradation region. The second specialized tone curve therefore satisfies the following characteristics 2B and 3B:

Characteristic 2B: In the low-gradation-region side of the intermediate gradation region, V is higher than in the low gradation region and higher than in the high gradation region.

Characteristic 3B: In the high-gradation-region side of the intermediate gradation region, V is lower than in the low gradation region and lower than in the high gradation region.

The Characteristics 2B and 3B are other examples of the above Characteristics 2 and 3, respectively.

(Flow of Image Processing in Smartphone 1)

Figure 4:
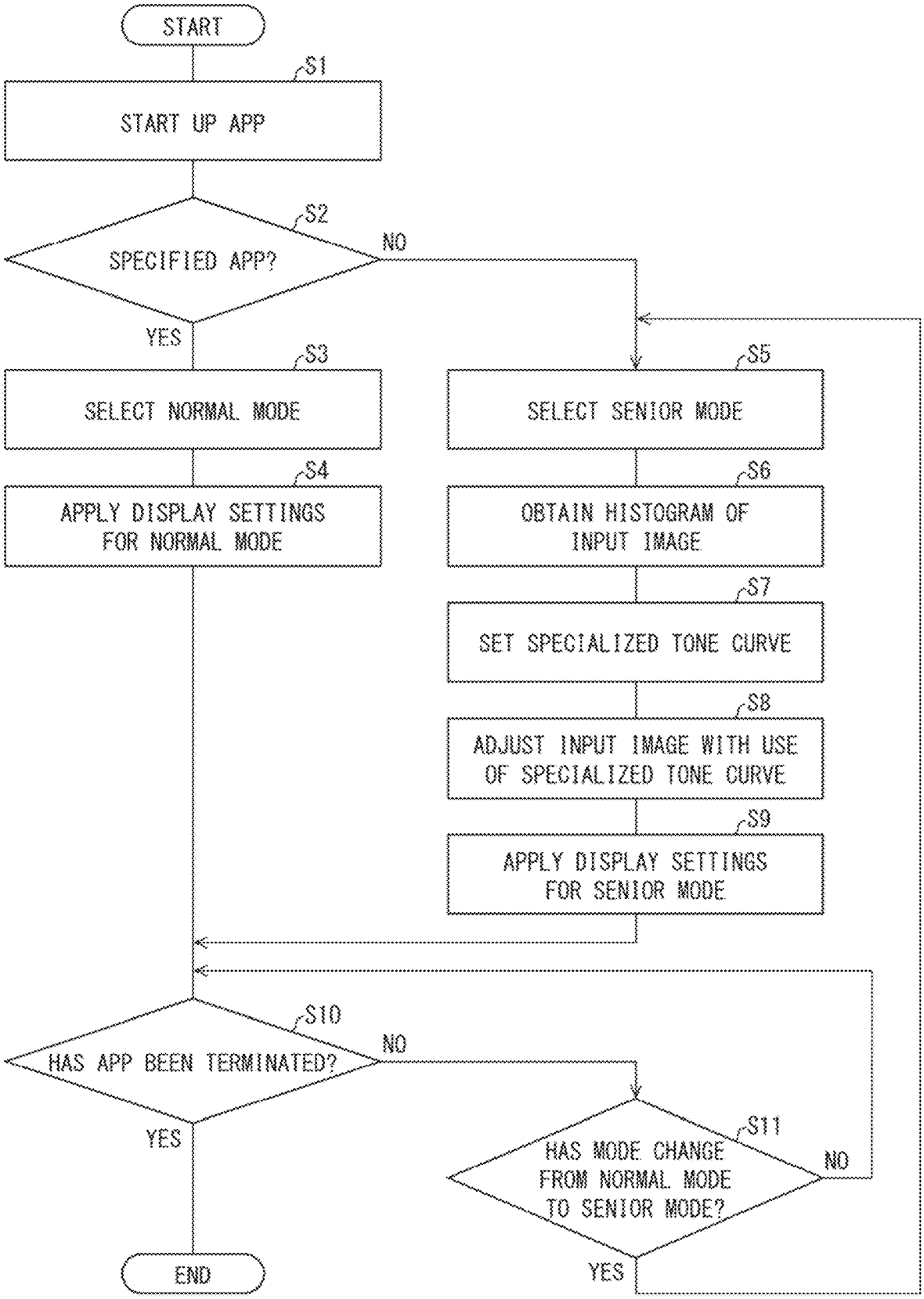
FIG. 4 is a diagram illustrating an example flow of image processing in the smartphone of FIG. 1.

FIG. 4 is a flowchart illustrating an example flow of image processing in the smartphone 1. Discussed below is an example in which display modes (operation modes) of the smartphone 1 include a normal mode and a specialized mode.

In the normal mode, the IMG2 is generated without use of the specialized tone curve to adjust the IMG1. In the specialized mode, the IMG2 is generated with use of the specialized tone curve to adjust the IMG1. The specialized mode is suited for providing a display screen having excellent viewability for elderly people. As such, the specialized mode can also be called a "senior mode."

First, the user carries out an operation on the TP 80 (input section 81) in order to run an app of choice which has been installed in advance on the smartphone 1. The app executing section 14 starts up the app in response to the operation (51). Thereafter, the app executing section 14 run the app which it has started (hereinafter, "running app").

The mode selecting section 13 selects a display mode of the smartphone 1. For example, the mode selecting section 13 selects the display mode of the smartphone 1 in accordance with the type of the running app. The mode selecting section 13 determines whether or not the running app is a specified app which has been set in advance (S2).

Setting the specified app(s) can be carried out at the time of production of the smartphone 1. The setting of the specified app(s) may be voluntarily changeable by the user. The specified app(s) may include an arbitrarily chosen app suited for viewing a natural image (or for viewing a moving image which includes natural images as frames thereof). Examples of the specified app(s) include an album app (image viewing app) and a moving image viewing app.

An app other than the specified app is referred to here as a "non-specified app." Possible examples of the non-specified app include a known web contents viewing app. Specific examples of the non-specified app include a browser app, a public transport information app, and a map app.

Compared to a non-natural image, a natural image has a lesser degree of unevenness in the distribution of gradation values thereof (see FIG. 6D, described later). As such, using the specialized tone curve to adjust a natural image (IMG1) would result in decreased viewability of an image (IMG2, display screen) obtained after adjustment.

Furthermore, in many cases, a natural image includes imagery of various objects existing in the natural world (imagery which the user is used to seeing). Using the specialized tone curve to adjust imagery of such objects may, in some cases, generate an output image which seems strange to the user. This is because there may be a large difference between how the imagery of the objects appears in the input image (i.e., how the user is used to seeing the imagery) and how the imagery of the same objects appears in the output image.

As such, in a case where it is highly likely that a user will view a natural image, in order to prevent a decrease in the viewability of the display screen, it is preferable not to use the specialized tone curve. Thus, in a case where the running app is a specified app ("YES" in S2), the mode selecting section 13 selects the normal mode as the display mode (S3).

In this way, the smartphone 1 makes it possible to use the specialized tone curve selectively (switch the display mode) in accordance with the type of app that the user is using. This makes it possible to prevent a decrease in the viewability of the display screen.

In a case where the normal mode has been selected, the control section 10 applies display settings for the normal mode (S4). Note that the tone curve setting section 12 is inactive in the normal mode. In the normal mode, the adjustment section 15 uses a color adjustment table for normal mode (hereinafter, "normal color adjustment table") to set coloration (for example, color depth and/or color temperature) of the IMG1. The normal color adjustment table is stored in advance in the storage section 90. Note that a color adjustment table for the specialized mode (hereinafter, "specialized color adjustment table"; described later) is also stored in advance in the storage section 90.

For example, the adjustment section 15 uses the normal color adjustment table to adjust the coloration of the IMG1 so as to generate the IMG2. The adjustment section 15 supplies the IMG2 thus generated to the display section 82. However, coloration adjustment processing by the adjustment section 15 is not essential. The adjustment section 15 may, in the normal mode, output the IMG1 as is, as the IMG2.

Furthermore, in the normal mode, the BL control section 16 uses a BL luminance table for the normal mode (hereinafter, "normal BL luminance table") to set the luminance of the BL 83. The normal BL luminance table is stored in advance in the storage section 90. Note that a BL luminance table for the specialized mode (hereinafter, "specialized BL luminance table"; described later) is also stored in advance in the storage section 90.

In contrast, in a case where the running app is not a specified app ("NO" in S2), the mode selecting section 13 selects the specialized mode (senior mode) as the display mode (S5). For example, in a case where the normal mode has been selected as the display mode, the non-specified app being started up triggers the mode selecting section 13 to switch the display mode from the normal mode to the specialized mode.

In this way, the smartphone 1 makes it possible to automatically change from the normal mode to the specialized mode without the need for the user to perform an operation to change the display mode. This provides a high level of user friendliness for elderly users who may not be familiar with how to operate the smartphone 1.

In the specialized mode, the image analyzing section 11 analyzes the IMG1. Specifically, by analyzing the IMG1, the image analyzing section 11 obtains a histogram (hereinafter also referred to as "HIST") which indicates a distribution of gradation values of each pixel in the IMG1 (S6). The histogram may be called a gradation value histogram (or a luminance histogram). A horizontal axis (class) of the HIST represents x (gradation values of the IMG1). A vertical axis (frequency) of the HIST represents the number of pixels in IMG1 having the gradation value x (see FIG. 6A to FIG. 6D, described later).

Next, the tone curve setting section 12 sets the specialized tone curve in accordance with the HIST (S7). Specifically, the tone curve setting section 12 sets, in accordance with the HIST, (i) V in the low-gradation-region side of the intermediate gradation region of the specialized tone curve and (ii) V in the high-gradation-region side of the intermediate gradation region of the specialized tone curve. The following description will discuss one example of a method for setting the specialized tone curve.

As one example, the image analyzing section 11 analyzes the HIST and calculates a representative value (statistic) of gradation values in the IMG1 (this representative value hereinafter referred to as "GW"). For example, the image analyzing section 11 calculates the center of gravity of gradation values in the IMG1 (which can also be said to be the center of gravity of the histogram) for use as GW. GW can be calculated by using a known method.

An input image in which $0 \leq GW < 0.5$ may be called a "comparatively dark input image." An input image in which $0.5 < GW \leq 1$ may be called a "comparatively bright input image." An input image in which GW=0.5 may be called an "input image of normal brightness."

A table representing the above-described f1(x) (hereinafter, "first specialized tone curve table") and a table representing the above-described f2(x) (hereinafter, "second specialized tone curve table") are stored in advance in the storage section 90. The tone curve setting section 12 sets the specialized tone curve with use of (i) GW calculated by the image analyzing section 11 and (ii) f1(x) and f2(x) which have been set in advance.

Figure 5:
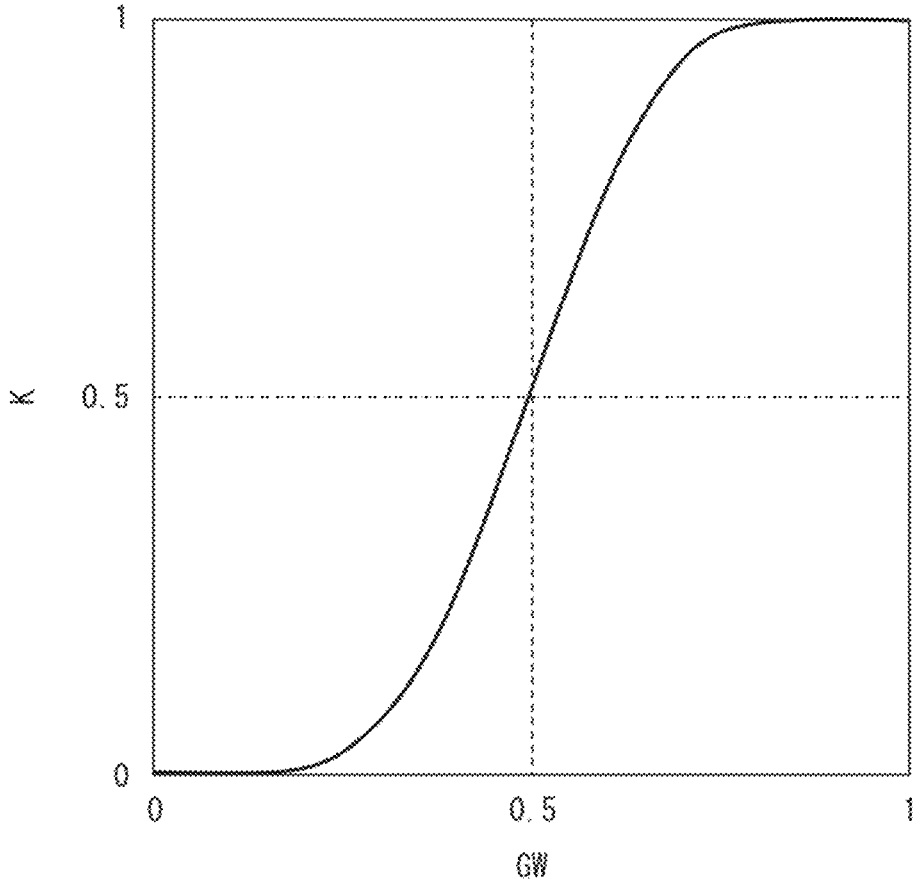
FIG. 5 illustrates an example of a coefficient setting graph.

As one example, the tone curve setting section 12 uses the graph shown in FIG. 5 (hereinafter, "coefficient setting graph") to set K (a coefficient) which corresponds to GW. The coefficient setting graph illustrates a correlation between GW and K. The coefficient setting graph can be expressed by, for example, a known function representing a sigmoid curve. A table representing the coefficient setting graph (hereinafter, "coefficient setting table") is also stored in advance in the storage section 90. K is a number satisfying $0 \leq K \leq 1$. As illustrated in FIG. 5, the coefficient setting graph shows a function in which K increases monotonically. As such, K=0 when GW=0, and K=1 when GW=1. Furthermore, the coefficient setting graph is set so that K=0.5 when GW=0.5.

The tone curve setting section 12 uses the following Formula (1) to set the specialized tone curve (y=f(x)).

$$f(x)=K\times f1(x)+(1-K)\times f2(x) \quad (1)$$

In other words, the tone curve setting section 12 uses the Formula (1) to set a table representing the specialized tone curve (hereinafter, "specialized tone curve table").

As one example, in a case where GW=0, K=0, and thus f(x)=f2(x). In a case where $0 \leq GW < 0.5$, $K < 1-K$. As such, in the Formula (1), as a component of f(x), f2(x) is more predominant than f1(x). As such, f(x) becomes the second specialized tone curve (a specialized tone curve which satisfies the Characteristics 1, 2B, and•3B). It therefore becomes possible to apply the second specialized tone curve to a comparatively dark input image. According to Formula (1), as GW decreases, f(x) becomes closer to f2(x).

In another example, in a case where GW=1, K=1, and thus f(x)=f1(x). In a case where $0.5 < GW \leq 1$, $K > 1-K$. As such, in the Formula (1), as a component of f(x), f1(x) is more predominant than f2(x). As such, f(x) becomes the first specialized tone curve (a specialized tone curve which satisfies the Characteristics 1, 2A, and•3A). It therefore becomes possible to apply the first specialized tone curve to a comparatively bright input image. According to Formula (1), as GW increases, f(x) becomes closer to f1(x).

In a case where GW=0.5, K=0.5, and thus $f(x)=\frac{1}{2}\{f1(x)+f2(x)\}=x$. In other words, f(x) becomes the normal tone curve. As such, the specialized tone curve is not applied to an input image of normal brightness.

In this way, the tone curve setting section 12 can set f(x) in accordance with GW (i.e., the tone curve setting section 12 can change the shape of the specialized tone curve accordance with GW). As such, the tone curve setting section 12 can, in accordance with GW, change V in the low-gradation-region side of the intermediate gradation region in f(x) and V in the high-gradation-region side of the intermediate gradation region in f(x).

Next, with use of the specialized tone curve set by the tone curve setting section 12, the adjustment section 15 adjusts the gradation of the IMG1 (i.e., generates the IMG2) (S8, adjusting step). In the smartphone 1 it is possible to adjust the IMG1 with use of the specialized tone curve set in accordance with the brightness of the IMG1. It is therefore possible to effectively improve viewability of the display screen in the specialized mode.

In a case where the specialized mode has been selected, the control section 10 applies display settings for the specialized mode (for the senior mode) (S9). In the specialized mode, the adjustment section 15 sets the coloration of the IMG2 with use of the specialized color adjustment table. In general, a human's color perception decreases with age. As such, in the specialized mode, in order to improve viewability for senior users, the adjustment section 15 carries out adjustment so that the coloration of each pixel of the image is more strongly emphasized than in the normal mode.

In the specialized mode, the BL control section 16 sets the luminance of the BL 83 with use of a specialized BL luminance table. In general, an amount of light which reaches a human's retina decreases with age. As such, in the specialized mode, in order to improve viewability for a senior user, the BL control section 16 sets the luminance of the BL 83 so as to be higher than in the normal mode.

Note that in the specialized mode, the adjustment section 15 preferably carries out adjustment such that the color temperature of each pixel in the input image is lower than in the normal mode. Such adjustment makes it possible to cancel out an excessive increase in perceived brightness of the display screen which is caused by the BL having increased luminance as compared to in the normal mode.

The app executing section 14 monitors the state of the running app. As one example, the app executing section 14 determines whether or not the user has carried out an operation to terminate the running app (S10). In a case where the running app has been terminated by the user's operation ("YES" in S10), the processing ends.

However, in a case where the running app continues to run ("NO" in S10), the mode selecting section 13 determines whether or not there has been a change in the display mode which was selected in S3 or S5. As one example, an application programming interface (API) can instruct the mode selecting section 13 to change the display mode. Alternatively, the mode selecting section 13 may change the display mode in response to a predetermined operation by the user, as described later.

As an example for convenience of explanation, FIG. 4 illustrates an example in which the normal mode has been selected in S3. In such a case, the mode selecting section 13 determines whether or not there has been a change from the normal mode to the specialized mode (S11). In a case where there has been a change from the normal mode to the specialized mode ("YES" in S11), the processing returns to S5. In a case where there has not been a change from the normal mode to the specialized mode ("NO" in S11), the processing returns to S10. Thereafter, similar processing is repeated.

Note that in a case where the specialized mode is selected in S5, the mode selecting section 13 determines, in S11, whether or not there has been a change from the specialized mode to the normal mode. In a case where there has been a change from the specialized mode to the normal mode, the processing returns to S3. In a case where there has not been a change from the specialized mode to the normal mode, the processing returns to S10. Thereafter, similar processing is repeated.

(Example of Histogram)

Figure 6A:
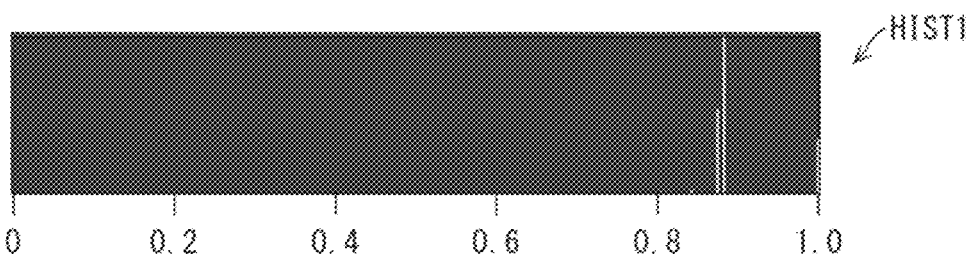
FIG. 6A, FIG. 6B, FIG. 6C, and FIG. 6D are examples of a histogram of an input image.
Figure 6B:
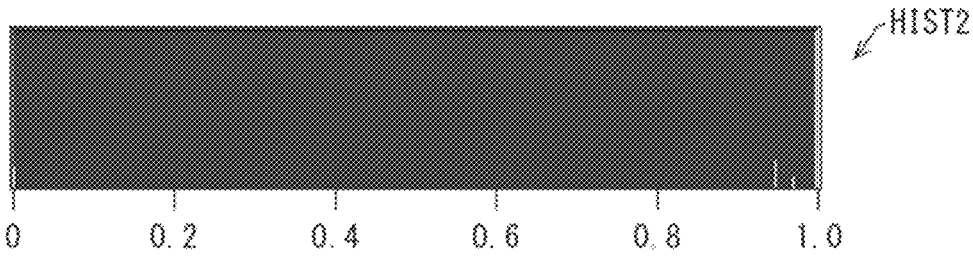
Figure 6C:
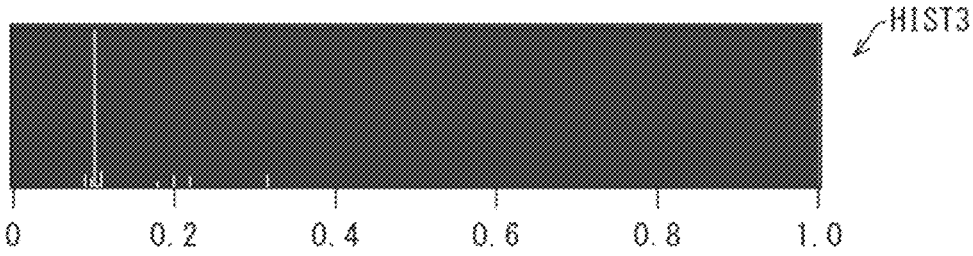

FIG. 6A to FIG. 6D illustrate examples of histograms (HIST) of various types of the IMG1. As is described later, the shape of a histogram differs greatly in accordance with the type of the IMG1. Discussed firstly are various examples of display screens of a non-specified app. As illustrated in FIG. 6A to FIG. 6C, the display screen of a non-specified app is a typical example of an input image in which there is an marked degree of unevenness in the distribution of the gradation value (hereinafter, "gradation distribution").

(Example of Histogram of Display Screen of Non-Specified App)

FIG. 6A involves a map app as one example of a non-specified app. FIG. 6A is a histogram of the IMG1 in a case where the IMG1 is a display screen of a map app. The histogram shown in FIG. 6A is hereinafter referred to as "HIST1."

In general, the display screen of a non-specified app often has a background whose keynote color is a bright color (e.g., white). As such, in the HIST1, a majority of the pixels are in the high gradation region. In other words, in the HIST1, a high gradation component (a component in the high gradation region) is extremely predominant. In particular, in the HIST1, an intermediate gradation component (a component in the intermediate gradation region) and a low gradation component (a component in the low gradation region) are both so small that they can be considered to be almost 0.

In many cases, the layout of web content is set in conformance with various standards. For example, JIS X 8341-3:2016 ("Guidelines for older persons and persons with disabilities—Information and communications equipment, software and services—Part 3: Web content") requires a sufficiently high contrast between background color and color of text in order to improve viewability of the text of web content. Specifically, JIS X 8341-3:2016 requires that in a case where a background color is the brightest color of web content, objects (e.g., text) representing important information have a brightness which is set so as to be not more than half the brightness of the background color.

Due to this, on a display screen of a non-specified app, the color of text is often set to be a color (such as black) which has excellent contrast with the background color. As such, in the HIST1, pixels corresponding to text are in the low gradation region. However, in the display screen of the map app, the area of a region in which text is displayed is sufficiently smaller than that of a region in which the background is displayed. As such, in the HIST1, only a very small number of pixels have luminance in the low gradation region.

Furthermore, a display screen of a non-specified app, which is a non-natural image (i.e., an example of a digital image designed by a person) is often created so as to have fewer colors than does a natural image, from the viewpoint of simplifying the design of the image. As such, in the display screen of a non-specified app, there are even fewer pixels in the intermediate gradation region than there are pixels in the low gradation region.

FIG. 6B involves a browser app as another example of a non-specified app. FIG. 6B is a histogram of the IMG1 in a case where the IMG1 is a display screen of a news site viewed in a browser app. The histogram shown in FIG. 6B is hereinafter referred to as "HIST2." In general, the display screen of a news site often has a background whose keynote color is a bright color, similarly to the display screen of a map app. As such, as with the HIST1, in the HIST2 a high gradation component is extremely predominant.

FIG. 6C is a histogram of the IMG1 in a case where the IMG1 is a display screen of an app having a background whose keynote color is a dark color (e.g., black). The histogram shown in FIG. 6C is hereinafter referred to as "HIST3." Some users prefer a dark background color when using an app. As such, some users may change preset display conditions (display settings) when using a non-specified app. For example, some users may carry out an operation so as to invert the gradation values of a preset display screen (i.e., to invert the brightness and darkness of a display screen).

The example of FIG. 6C assumes a display screen of a non-specified app for which the background color is made dark in the manner described above. In the example of FIG. 6C, pixels corresponding to text are in the high gradation region. In contrast to the HIST1 and the HIST2, it is the low gradation component which is extremely predominant in the HIST3. In particular, in the HIST3, the intermediate gradation component and the high gradation component are both so small that they can be considered to be almost 0.

(Example of Histogram of Natural Image)

Figure 6D:
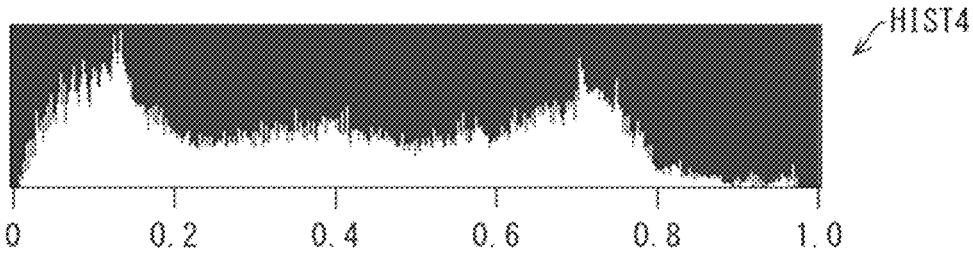

FIG. 6D is a histogram of the IMG1 in a case where the IMG1 is a natural image. The histogram shown in FIG. 6D is hereinafter referred to as "HIST4." As described above, a natural image often has a greater number of colors than does a non-natural image (a display screen of a non-specified app). As such, the HIST4 has a large low gradation component, a large intermediate gradation component, and a large high gradation component. The histogram of a natural image therefore differs greatly from the histogram of a non-natural image. In this way, a natural image is a typical example of an input image in which there is a low degree of unevenness in the gradation distribution.

Example of Gradation Value Adjustment Processing in Smartphone 1

First Example

Figure 7A:
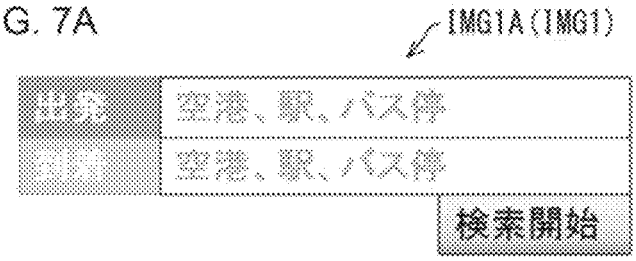
FIG. 7A, FIG. 7B, and FIG. 7C illustrate a First Example.

Each of FIG. 7A to FIG. 10C illustrates an example of gradation value adjustment processing (adjustment of gradation values of an input image) carried out by the smartphone 1. FIG. 7A to FIG. 7C illustrate an example (First Example) of gradation value adjustment processing carried out on a display screen of a public transport information app. FIG. 7A shows the IMG1 of the First Example (hereinafter, "IMG1A"). The IMG1A is a display screen of the public transport information app (a display screen prior to gradation value adjustment processing). The IMG1A is an example of a non-natural image whose background color is white. The IMG1A has a histogram which is largely similar to the histograms of FIG. 6A and FIG. 6B.

As comparative examples, the inventor adjusted gradation values of various types of the IMG1 with use of an S-shaped tone curve. Hereinafter, an output image generated with use of an S-shaped tone curve (an image which has been subjected to gradation value adjustment processing with use of an S-shaped tone curve) is referred to as "IMG2*r*." The IMG2*r* of the First Example (i.e., an output image obtained by adjusting the gradation values of the IMG1A with use of an S-shaped tone curve) is referred to as "IMG2Ar." FIG. 7B shows the IMG2Ar.

Furthermore, as examples in accordance with an embodiment of the present invention, the inventor adjusted gradation values of various types of the IMG1 with use of the specialized tone curve. Specifically, in the First Example, the inventor adjusted the IMG1A with use of the first specialized tone curve (i.e., generated an IMG2). The IMG2 of the First Example is referred to as "IMG2A." FIG. 7C shows the IMG2A.

Figure 7B:
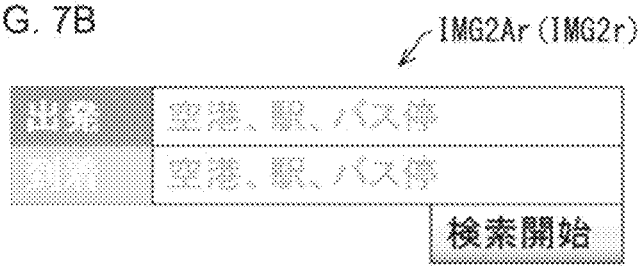
Figure 7C:
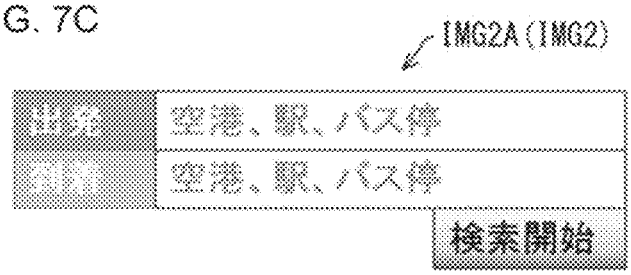

As illustrated in FIG. 7B and FIG. 7C, it was confirmed that the IMG2A has better contrast than the IMG2Ar. In other words, it was confirmed that use of the specialized tone curve (first specialized tone curve) made it possible to improve viewability of a display screen, as compared to a case in which the S-shaped tone curve was used.

As described above, the S-shaped tone curve has a shape which is suited for improving contrast in the intermediate gradation region of an input image (see FIG. 2). However, while adjustment using the S-shaped tone curve does effectively improve contrast in the intermediate gradation region of an input image, it decreases contrast of the low gradation region and the high gradation region of the input image. This is because with the S-shaped tone curve, V is smaller in the low gradation region and in the high gradation region than in the intermediate gradation region. In other words, adjustment using the S-shaped tone curve can be said to be gradation value adjustment which sacrifices contrast in the low gradation region and high gradation region of an input image.

As such, the inventor discovered that, problematically, the S-shaped tone curve is not suited for adjustment of a non-natural image. As one example, it was confirmed that adjusting the IMG1A (image in which high gradation pixels are predominant) with use of the S-shaped tone curve caused the IMG2Ar to have lower contrast than the IMG1A.

In the First Example, the color of the text of the IMG2Ar was, overall, brighter than that of the IMG1A. As such, in the IMG2Ar, there was lower contrast between the color of the text and the background color than in the IMG1A. As a result, the IMG2Ar had poorer viewability of text than the IMG1A. In general, a human's visual acuity with regards to contrast decreases with age. The IMG2Ar therefore has particularly poor viewability for elderly people.

In contrast to this, the specialized tone curve has a shape which is suited for improving contrast in the low gradation region and the high gradation region of an input image (see FIG. 3). This is because, with the specialized tone curve, V is substantially constant in the low gradation region and in the high gradation region ($V \approx 1$), as described in Characteristic 1 above.

As such, in contrast to the S-shaped tone curve, the specialized tone curve can be said to be suitable for adjustment of a non-natural image. In view of this, the inventor arrived at the idea of using the specialized tone curve to improve the contrast of a non-natural image.

In particular, the first specialized tone curve is suited for adjustment of the IMG1A (an image in which high gradation pixels are predominant). With the first specialized tone curve, in the high-gradation-region side of the intermediate gradation region, V is (i) higher than in the low gradation region and (ii) higher than in the high gradation region, as described in Characteristic 3A above. As such, with the first specialized tone curve, it is possible to effectively improve contrast particularly in the high-gradation-region side of the intermediate gradation region. It is therefore possible to, for example, in the high-gradation-region side of the intermediate gradation region, improve contrast between the background color and the color of an object (e.g., the color of text) which differs from the background color.

As one example, it was confirmed that adjusting the IMG1A with use of the first specialized tone curve caused the IMG2A to have improved contrast in comparison to the IMG1A. In the First Example, the color of the text of the IMG2A was, overall, darker than that of the IMG1A. As such, in the IMG2A, there was better contrast between the color of the text and the background color than in the IMG1A. As a result, the IMG2A had better viewability of text than the IMG1A. In particular, the IMG2A had high viewability for elderly people.

Second Example

Figure 8A:
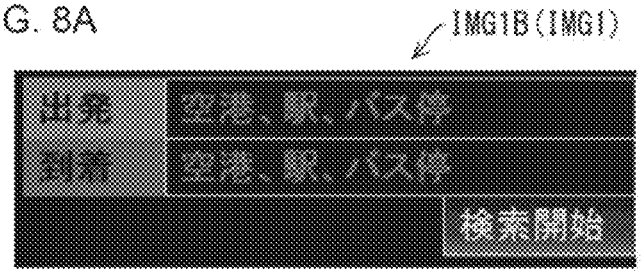
FIG. 8A, FIG. 8B, and FIG. 8C illustrate a Second Example.
Figure 8B:
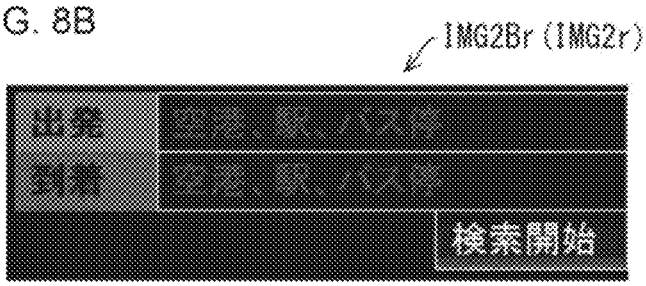
Figure 8C:
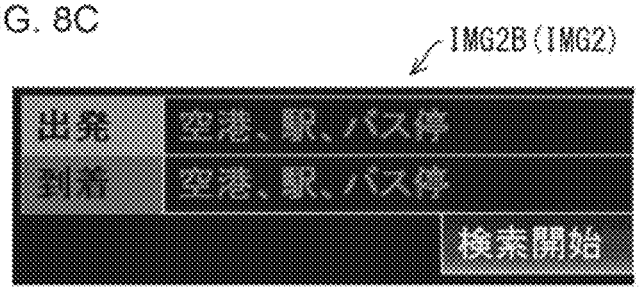

FIG. 8A to FIG. 8C illustrate another example (Second Example) of gradation value adjustment processing carried out on a display screen of a public transport information app. FIG. 8A shows the IMG1 of the Second Example (hereinafter, "IMG1B"). The IMG is an example of a non-natural image whose background color is black. The IMG is obtained by inverting the gradation values of the IMG1A. The IMG1B has a histogram which is largely similar to the histogram of FIG. 6C.

The IMG2*r* of the Second Example (i.e., an output image obtained by adjusting the gradation values of the IMG1B with use of an S-shaped tone curve) is referred to as "IMG2Br." FIG. 8B shows the IMG2Br. The IMG2 of the Second Example (i.e., an output image obtained by adjusting the gradation values of the IMG1B with use of the specialized tone curve) is referred to as "IMG2B." Specifically, the inventor obtained the IMG2B by adjusting the IMG1B with use of the second specialized tone curve. FIG. 8C shows the IMG2B.

As illustrated in FIG. 8B and FIG. 8C, it was confirmed that the IMG2B has better contrast than the IMG2Br. In other words, it was confirmed that use of the specialized tone curve (second specialized tone curve) made it possible to also improve viewability of a display screen in the case of a non-natural image having a dark background color.

In the Second Example, the color of the text of the IMG2Br was, overall, darker than that of the IMG1B. As such, in the IMG2Br, there was lower contrast between the color of the text and the background color than in the IMG1B. As a result, the IMG2Br had poorer viewability of text than the IMG1B. Similarly to the IMG2Ar, the IMG2Br had poor viewability particularly for elderly people.

In contrast, the second specialized tone curve is suited for adjustment of the IMG1B (an image in which low gradation pixels are predominant). With the second specialized tone curve, in the low-gradation-region side of the intermediate gradation region, V is (i) higher than in the low gradation region and (ii) higher than in the high gradation region, as described in Characteristic 2B above. As such, with the second specialized tone curve, it is possible to effectively improve contrast particularly in the low-gradation-region side of the intermediate gradation region. It is therefore possible to, for example, in the low-gradation-region side of the intermediate gradation region, improve contrast between the background color and the color of an object (e.g., the color of text) which differs from the background color.

As one example, it was confirmed that adjusting the IMG1B with use of the second specialized tone curve caused the IMG2B to have improved contrast in comparison to the IMG1B. In the Second Example, the color of the text of the IMG2B was, overall, brighter than that of the IMG1B. As such, in the IMG2B, there was better contrast between the color of the text and the background color than in the IMG1B. As a result, the IMG2B had better viewability of text than the IMG1B. In particular, the IMG2B had high viewability for elderly people.

Third Example

Figure 9A:
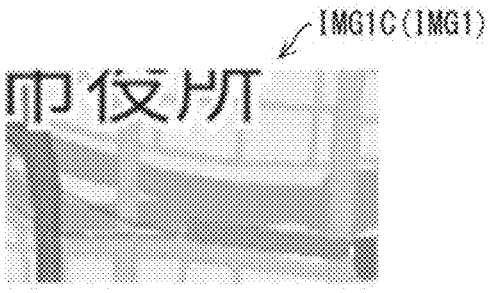
FIG. 9A, FIG. 9B, and FIG. 9C illustrate a Third Example.
Figure 9B:
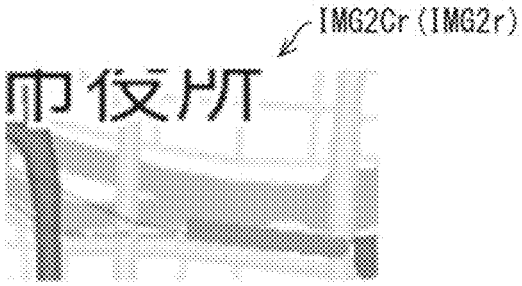
Figure 9C:
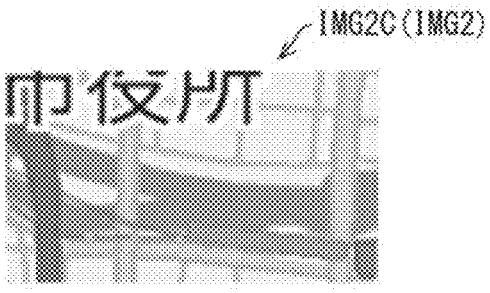

FIG. 9A to FIG. 9C illustrate an example (Third Example) of gradation value adjustment processing carried out on a display screen of a map app. FIG. 9A shows the IMG1 of the Third Example (hereinafter, "IMG1C"). The IMG1C is a display screen of the map app (a display screen prior to gradation value adjustment processing). The IMG1C is another example of a non-natural image whose background color is white. The IMG1C has a histogram which is largely similar to the histograms of FIG. 6A and FIG. 6B.

The IMG2*r* of the Third Example (i.e., an output image obtained by adjusting the gradation values of the IMG1C with use of an S-shaped tone curve) is referred to as "IMG2Cr." FIG. 9B shows the IMG2Cr. The IMG2 of the Third Example (i.e., an output image obtained by adjusting the gradation values of the IMG1C with use of the specialized tone curve) is referred to as "IMG2C." Specifically, the inventor obtained the IMG2C by adjusting the IMG1C with use of the first specialized tone curve. FIG. 9C shows the IMG2C.

As illustrated in FIG. 9B and FIG. 9C, it was confirmed that the IMG2C has better contrast than the IMG2Cr. In other words, as was the case with the display screen of the public transport information app, it was confirmed that, for a display screen of a map app (having a white background color) as well, use of the specialized tone curve (first specialized tone curve) made it possible to improve viewability of a display screen, as compared to a case in which the S-shaped tone curve was used.

The color of various objects in the IMG2Cr was, overall, brighter than in the IMG1C. As such, similarly to the IMG2Ar (of the First Example), the IMG2Cr had poor viewability particularly for elderly people.

In contrast, the color of various objects in the IMG2C was, overall, darker than in the IMG1C. As such, similarly to the IMG2A (of the First Example), the IMG2C had high viewability particularly for elderly people.

Fourth Example

Figure 10A:
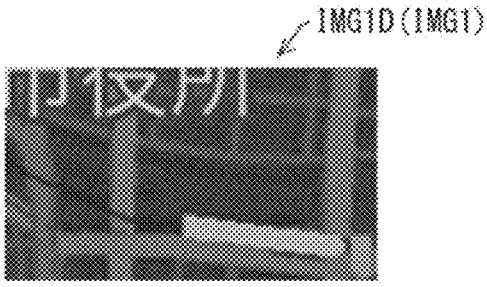
FIG. 10A, FIG. 10B, and FIG. 10C illustrate a Fourth Example.
Figure 10B:
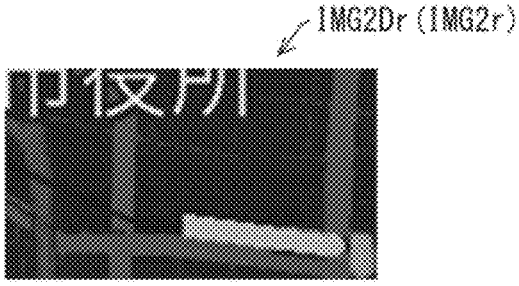
Figure 10C:
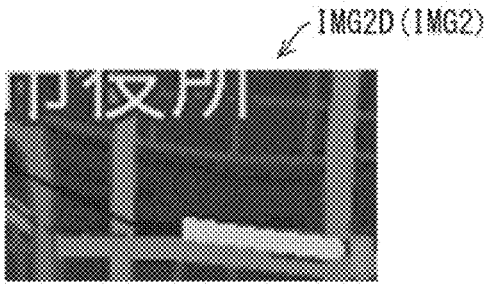

FIG. 10A to FIG. 10C illustrate another example (Fourth Example) of gradation value adjustment processing carried out on a display screen of a map app. FIG. 10A shows the IMG1 of the Fourth Example (hereinafter, "IMG1D"). The IMG1D is another example of a non-natural image whose background color is black. The IMG1D is obtained by inverting the gradation values of the IMG1C. The IMG1D has a histogram which is largely similar to the histogram of FIG. 6C.

The IMG2*r* of the Fourth Example (i.e., an output image obtained by adjusting the gradation values of the IMG1D with use of an S-shaped tone curve) is referred to as "IMG2Dr." FIG. 10B shows the IMG2Dr. The IMG2 of the Fourth Example (i.e., an output image obtained by adjusting the gradation values of the IMG1D with use of the specialized tone curve) is referred to as "IMG2D." Specifically, the inventor obtained the IMG2D by adjusting the IMG1D with use of the second specialized tone curve. FIG. 10C shows the IMG2D.

As illustrated in FIG. 10B and FIG. 10C, it was confirmed that the IMG2D has better contrast than the IMG2Dr. In other words, as was the case with the display screen of the public transport information app, it was confirmed that, for a display screen of a map app (having a black background color) as well, use of the specialized tone curve (second specialized tone curve) made it possible to improve viewability of a display screen, as compared to a case in which the S-shaped tone curve was used.

The color of various objects in the IMG2Dr was, overall, darker than in the IMG1D. As such, similarly to the IMG2Br (of the Second Example), the IMG2Dr had poor viewability particularly for elderly people.

In contrast, the color of various objects in the IMG2D was, overall, brighter than in the IMG1D. As such, similarly to the IMG2B (of the First Example), the IMG2D had high viewability particularly for elderly people.

(Effects of Smartphone 1)

As described above, adjusting a non-natural image (input image) with use of the specialized tone curve makes it possible to provide a display screen having improved viewability, as compared to a case where conventional gradation value adjustment processing (adjustment using an S-shaped tone curve) is carried out. In particular, it is possible to suitably improve contrast of a non-natural image, and thus it is possible to provide a display screen having high viewability for elderly people.

Furthermore, with the smartphone 1, it is possible to set the specialized tone curve in accordance with results of analysis of the input image. As such, it is possible to set an appropriate specialized tone curve in accordance with brightness of the input image (more specifically, overall brightness of the input image). As such, it is possible to apply a specialized tone curve which is suited to the input image.

(Example of Changing of Display Mode in Accordance with User Operation)

The mode selecting section 13 may be configured to change the display mode in response to an operation by the user. As one example, the control section 10 may control the TP 80 (display section 82) so as to display a button (hereinafter, "IMGS") for allowing the user to select a display mode. For example, the control section 10 may control the TP 80 so as to display the IMGS in response to a predetermined flicking operation carried out on the TP 80 (input section 81) by the user.

Figure 11:
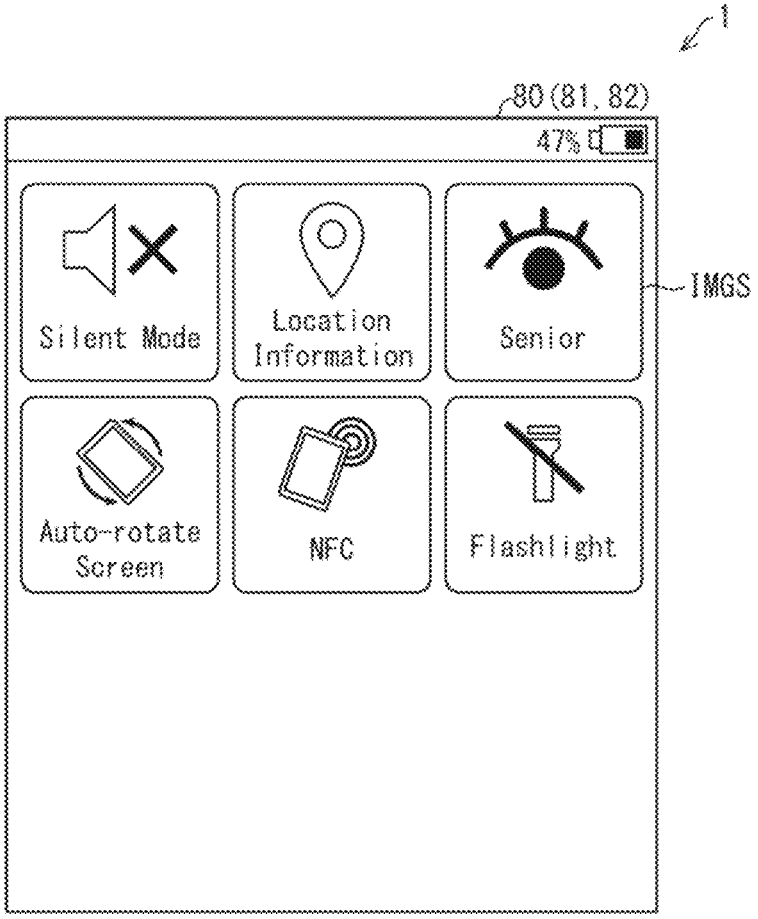
FIG. 11 schematically illustrates an example of a display screen of the smartphone of FIG. 1.

FIG. 11 schematically illustrates an example of a display screen of the TP 80. In the example of FIG. 11, the IMGS is displayed on the TP 80 as an icon (object) capable of accepting a touch operation by the user. In the example of FIG. 11, the IMGS is displayed as an icon which suggests the IMGS is for setting a display mode for seniors (an icon including an image representing an eye and the word "Senior"). The mode selecting section 13 changes the display mode in response to a touch operation carried out on the IMGS by the user.

For example, assume a case where the normal mode has been selected as the current display mode. In such a case, the user touching the IMGS once triggers the mode selecting section 13 to switch the display mode from the normal mode to the specialized mode. In a case where the user touches the IMGS once more, the mode selecting section 13 switches the display mode from the specialized mode to the normal mode. Such a configuration makes it possible for the user to select the display mode at will.

This enables a further increase in user friendliness. The IMGS may be used as a button for changing between various modes in the specialized mode (senior mode). For example, the IMGS may be used a button for switching between a first specialized mode (first senior mode) and a second specialized mode (second senior mode) (described later).

As one example, assume a case where the normal mode has been selected. In a case where the user touches the IMGS once, the mode selecting section 13 switches the display mode from the normal mode to the first specialized mode. In a case where the user touches the IMGS once more, the mode selecting section 13 switches the display mode from the first specialized mode to the second specialized mode. In a case where the user touches the IMGS yet once more, the mode selecting section 13 switches the display mode from the second specialized mode to the normal mode.

[Variation]

As a variation of Embodiment 1, the smartphone 1 may be configured such that processing to obtain the HIST (S6) is carried out before the processing to determine whether or not the running app is the specified app (S2). In such a case, the mode selecting section 13 may select the normal mode or the specialized mode as the display mode of the smartphone 1 in accordance with the HIST. As one example, the mode selecting section 13 may select the display mode of the smartphone 1 in accordance with GW.

For example, in a case where GW is in the low gradation region or the high gradation region, there is presumably a high likelihood that the IMG1 is a non-natural image (see HIST1 to HIST3). As such, in a case where $0 \leq GW < a$, and in a case where $b < GW \leq 1$, the mode selecting section 13 may select the specialized mode as the display mode of the smartphone 1.

Conversely, in a case where the GW is in the intermediate gradation region, there is presumably a high likelihood that the IMG1 is a natural image (see HIST4). As such, in a case where $a \leq GW \leq b$, the mode selecting section 13 may select the normal mode as the display mode of the smartphone 1.

With the above configuration, it is possible to automatically select either the normal mode or the specialized mode in accordance with the brightness of the IMG1. In other words, it is possible to automatically select a suitable display mode in accordance with the brightness of the input image, and it is therefore possible to improve user friendliness.

[Variation]

Embodiment 1 involved an example in which the entirety of the input image was analyzed (an example in which a histogram of the entirety of the input image was obtained). The smartphone 1 may, alternatively, be configured so as to divide the input image into a plurality of partial regions and analyze the partial regions on an individual basis.

As one example, the control section 10 uses a known algorithm so as to divide the input image into a P number of partial regions (i.e., a first region to a P-th region, where P is a natural number). For example, the control section 10 divides the input image into the P number of partial regions by dividing the input image into an m number of equal parts (where m is a natural number) in a horizontal direction and an n number of equal parts (where n is a natural number) in a vertical direction. In such a case, $P=m \times n$.

The image analyzing section 11 analyzes each of the first region to the P-th region (the P number of partial regions) and obtains respective histograms for each of the first region to the P-th region (i.e., a P number of histograms). Hereinafter, a histogram of a Q-th region is referred to as a Q-th histogram. Here, Q is a natural number which satisfies $1 \leq Q \leq P$.

The tone curve setting section 12 sets a specialized tone curve associated with the Q-th region (a specialized tone curve for the Q-th region) in accordance with the Q-th histogram. The adjustment section 15 then adjusts the Q-th region with use of the specialized tone curve for the Q-th region. In this way it is possible to apply differing specialized tone curves to each partial region of the input image. With this configuration, it is possible to further improve the viewability of the display screen.

Embodiment 2

Figure 12:
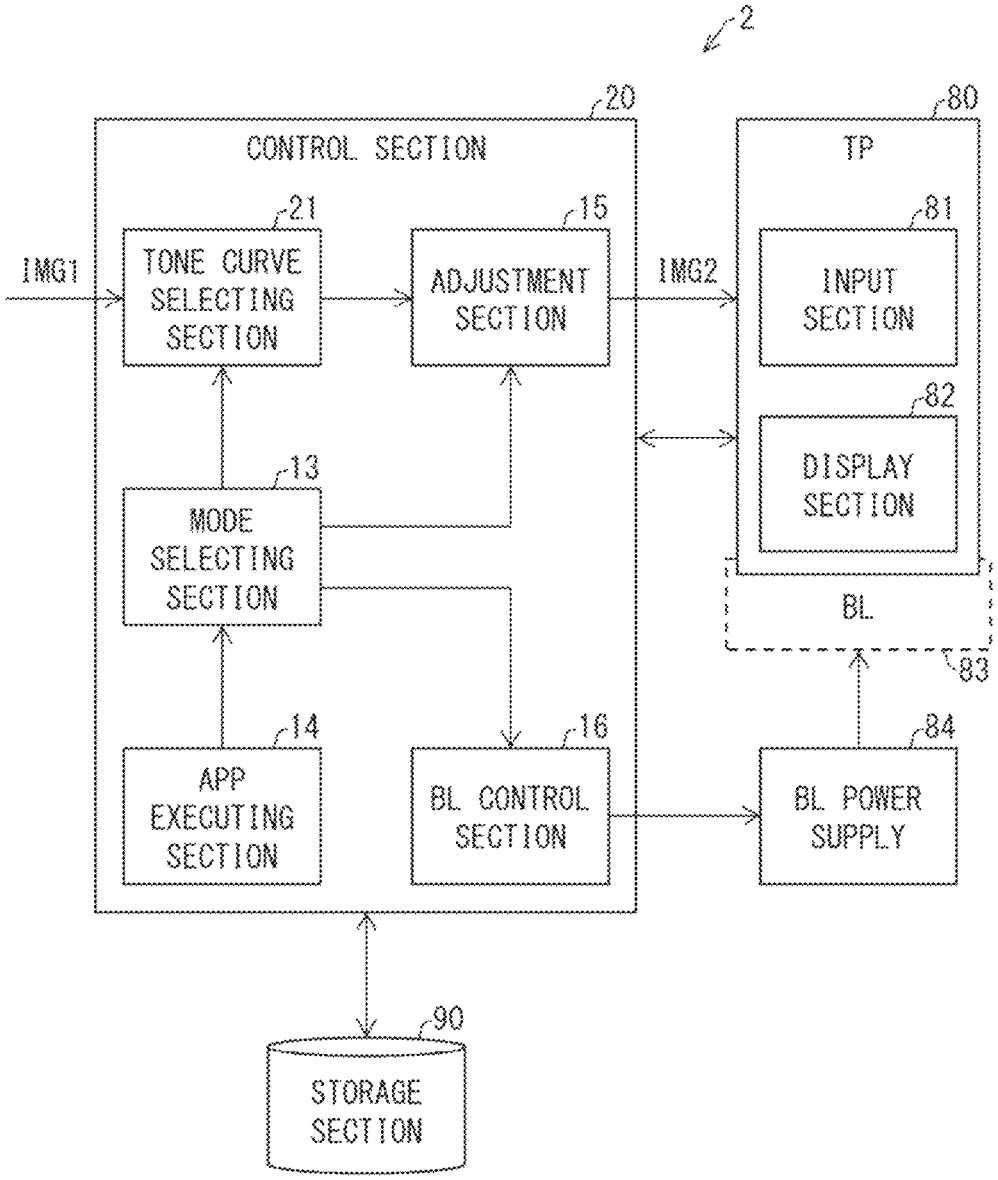
FIG. 12 is a functional block diagram illustrating a configuration of main parts of a smartphone in accordance with Embodiment 2.

FIG. 12 is a functional block diagram illustrating a configuration of main parts of a smartphone 2 (display device) in accordance with Embodiment 2. A control section of the smartphone 2 is referred to as a control section 20 (control device, image processing device). The control section 20 differs from the control section 10 in that, in the control section 20, the image analyzing section 11 is excluded and the tone curve setting section 12 is replaced with a tone curve selecting section 21.

In contrast to the control section 10, the control section 20 has neither (i) a function of analyzing the IMG1 (e.g., a function of obtaining the HIST) nor (ii) a function of setting the specialized tone curve. In this way, the control section 20 has a simplified configuration in comparison to the control section 10.

Embodiment 2 involves an example in which the specialized mode (senior mode) includes two modes: a first specialized mode (first senior mode) and a second specialized mode (second senior mode). The first specialized mode is a senior mode in which the IMG1 is adjusted with use of the first specialized tone curve which has been preset (a default first specialized tone curve). The second specialized mode is a senior mode in which the IMG1 is adjusted with use of the second specialized tone curve which has been preset (a default second specialized tone curve).

(Flow of Image Processing in Smartphone 2)

Figure 13:
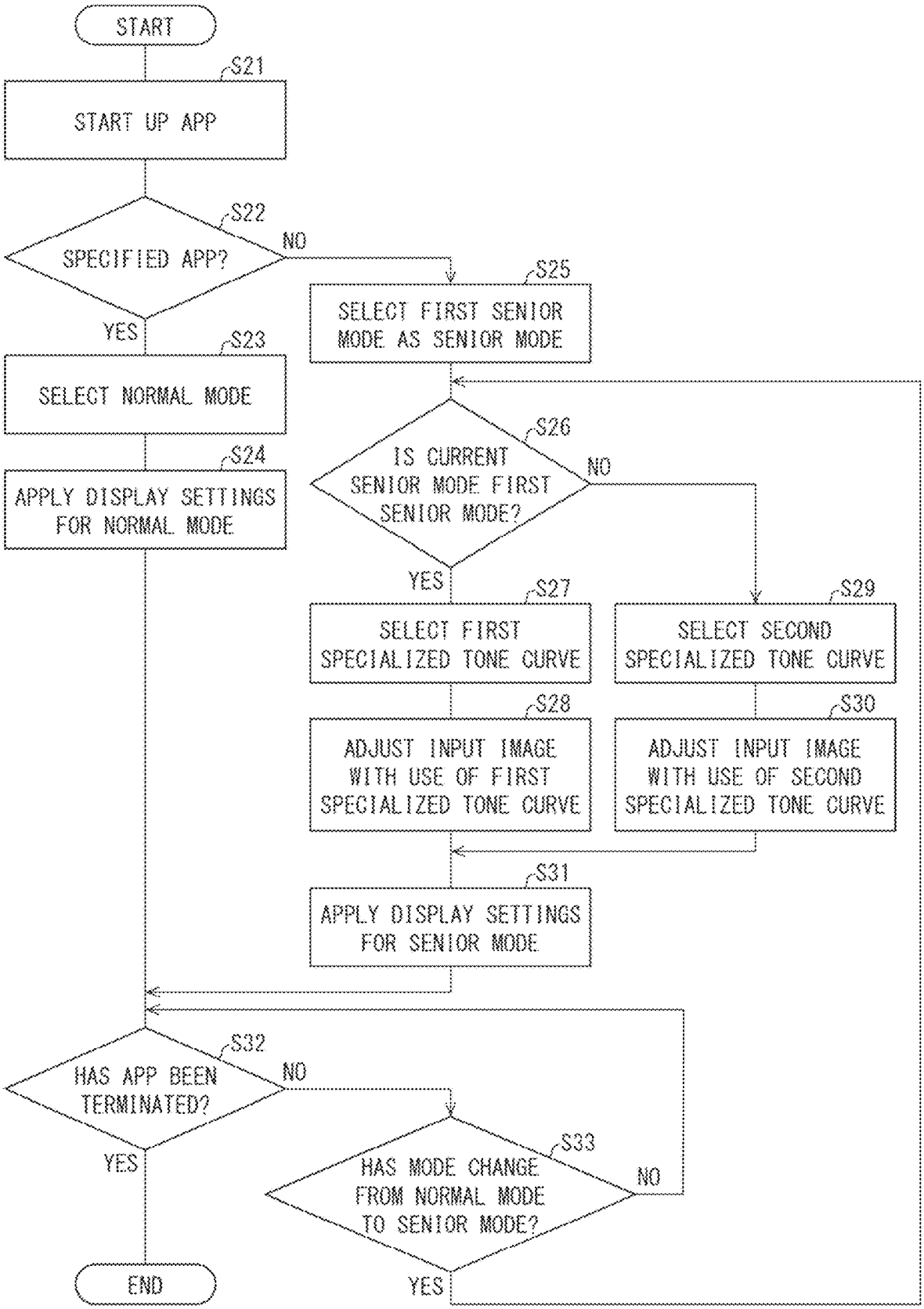
FIG. 13 is a diagram illustrating an example flow of image processing in the smartphone of FIG. 12.

FIG. 13 is a flowchart illustrating an example flow of image processing in the smartphone 2. Descriptions of processing which is similar to that of Embodiment 1 will be omitted below. That is, the descriptions of the example below will include only those portions of the processing which are unique to Embodiment 2.

In a case where the running app is not the specified app ("NO" in S22), the mode selecting section 13 selects, from among the first senior mode and the second senior mode, a specific preset mode (default senior mode). In Embodiment 2, the mode selecting section 13 selects the first senior mode as a default senior mode (S25).

As described above, the display screen of non-specified apps often has a background whose keynote color is a bright color. As such, it can be expected that a large number of non-natural images will have a histogram suited for adjustment with use of the first specialized tone curve. In light of this, the inventor set the first senior mode as the default senior mode in Embodiment 2. Note, however, that the second senior mode may alternatively be set as the default senior mode.

Next, the mode selecting section 13 determines whether or not the current senior mode is the first senior mode (S26). The mode selecting section 13 selects a specialized tone curve in accordance with the current senior mode. In a case where the current senior mode is the first senior mode ("YES" in S26), the tone curve selecting section 21 selects the first specialized tone curve which has been preset (default first specialized tone curve) (S27).

As one example, the tone curve selecting section 21 reads out, from the storage section 90, the first specialized tone curve table, which represents f1(x). In other words, the tone curve selecting section 21 selects f1(x) as the default first specialized tone curve. Thereafter, processing is carried out in a manner similar to that of Embodiment 1. Note that the display settings for the senior mode are the same in the first senior mode and the second senior mode.

In a case where the current senior mode is not the first senior mode ("NO" in S26), the current senior mode is the second senior mode. In such a case, the tone curve selecting section 21 selects the second specialized tone curve which has been preset (default second specialized tone curve) (S29). As one example, the tone curve selecting section 21 reads out, from the storage section 90, the second specialized tone curve table, which represents f2(x). In other words, the tone curve selecting section 21 selects f2(x) as the default second specialized tone curve. Thereafter, processing is carried out in a manner similar to that of Embodiment 1.

Thereafter, the mode selecting section 13 determines whether or not there has been a change in the display mode which was selected in S23 or S25. As an example for convenience of explanation, FIG. 13 illustrates a case in which the normal mode has been selected in S23. In such a case, the mode selecting section 13 determines whether or not there has been a change from the normal mode to the senior mode (S33). In a case where there has been a change from the normal mode to the senior mode ("YES" in S33), the processing returns to S26. In a case where there has not been a change from the normal mode to the senior mode ("NO" in S33), the processing returns to S32. Thereafter, similar processing is repeated.

Note that in a case where the senior mode is selected in S25, the mode selecting section 13 determines, in S33, whether or not there has been a change from the senior mode to the normal mode. In a case where there has been a change from the senior mode to the normal mode, the processing returns to S23. In a case where there has not been a change from the senior mode to the normal mode, the processing returns to S32. Thereafter, similar processing is repeated.

(Effects of Smartphone 2)

The smartphone 2 makes it possible to adjust a non-natural image (input image) with use of the specialized tone curve while employing a configuration which is simpler than that of the smartphone 1. Specifically, the smartphone 2 makes it possible to carry out adjustment with use of the specialized tone curve without analyzing the input image. This makes it possible to reduce the cost of a display device capable of providing high viewability of images for elderly people.

[Variation]

As described above, it can be expected that a large number of non-natural images will have a histogram suited for adjustment with use of the first specialized tone curve. As such, it can be expected that in the senior mode, the first specialized tone curve will be used more frequently than the second specialized tone curve. As such, in view of further reducing the cost of the smartphone 2, the smartphone 2 can be configured so as to have only the first senior mode (i.e., so as not to include the second senior mode).

[Software Implementation Example]

Functional blocks of the smartphones 1 and 2 (in particular, the control sections 10 and 20) can be realized by a logic circuit (hardware) provided in an integrated circuit (IC chip) or the like or can be alternatively realized by software.

In the latter case, each of the smartphones 1 and 2 includes a computer that executes instructions of a program that is software realizing the foregoing functions. The computer includes, for example, at least one processor (control device) and at least one storage medium on which the program is stored and from which the program can be read by the computer. An object of an aspect of the present invention can be achieved by the processor of the computer reading and executing the program stored in the storage medium. A central processing unit (CPU), for example, may be used as the processor. Examples of the storage medium encompass a non-transitory tangible medium such as read only memory (ROM), a tape, a disk, a card, a semiconductor memory, and a programmable logic circuit. The computer may further include, for example, random access memory (RAM) onto which the program is loaded. The program can be supplied to the computer via any transmission medium (such as a communication network or a broadcast wave) which allows the program to be transmitted. Note that an aspect of the present invention can also be achieved in the form of a computer data signal in which the program is embodied via electronic transmission and which is embedded in a carrier wave.

[Recap]

A display device (smartphone 1) in accordance with Aspect 1 of the present invention includes: a control device (control section 10) capable of generating an output image (IMG2) by adjusting an input image (IMG1); and a display section (82) configured to display the output image, the control device being capable of generating the output image by adjusting a gradation value of each pixel of the input image with use of specialized gradation change characteristics (specialized tone curve; e.g., CV1 or CV2), wherein assuming that: a gradation value of one pixel of the input image is considered to be an input gradation value (x); a gradation value of one pixel of the output image, which one pixel corresponds to the one pixel of the input image, is considered to be an output gradation value (y); in a gradation change characteristic (tone curve) which indicates a correlation between the input gradation value and the output gradation value, a gradation change rate (V) is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are: (i) the gradation change rate is substantially constant in the low gradation region and in the high gradation region; (ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

With the above configuration, in a case where the input image is an image having marked degree of unevenness in the gradation distribution thereof (i.e., a non-natural image, such as a display screen of a non-specified app), it is possible to adjust the input image with use of the specialized tone curve. As described above, differing from a conventional tone curve (such as an S-shaped tone curve), the specialized tone curve has characteristics suited for improving contrast of a non-natural image. This makes it possible to obtain an output image having excellent contrast. As a result, it is possible to provide a display screen which, compared to a conventional display screen, has superior viewability for elderly people.

In Aspect 2 of the present invention, the display device of Aspect 1 may be configured such that: the specialized gradation change characteristics include first specialized gradation change characteristics (first specialized tone curve; e.g., CV1), the first specialized gradation change characteristics being: (i) in the low-gradation-region side of the intermediate gradation region, the gradation change rate is lower than in the low gradation region and lower than in the high gradation region; and (ii) in the high-gradation-region side of the intermediate gradation region, the gradation change rate is higher than in the low gradation region and higher than in the high gradation region.

With the above configuration, it is possible to adjust an input image (non-natural image) with use of the first specialized tone curve. As described above, the first specialized tone curve has characteristics suited for improving contrast in a bright non-natural image. In many cases, the display screen of a non-specified app has a background whose keynote color is a bright color (see FIGS. 7 and 9). As such, by using the first specialized tone curve to adjust an input image, it is possible to improve viewability of a display screen in a large number of cases.

In Aspect 3 of the present invention, the display device in accordance with Aspect 1 or Aspect 2 may be configured such that: the specialized gradation change characteristics include second specialized gradation change characteristics (second specialized tone curve; e.g., CV2), the second specialized gradation change characteristic being: (i) in the low-gradation-region side of the intermediate gradation region, the gradation change rate is higher than in the low gradation region and higher than in the high gradation region; and (ii) in the high-gradation-region side of the intermediate gradation region, the gradation change rate is lower than in the low gradation region and lower than in the high gradation region.

With the above configuration, it is possible to adjust an input image (non-natural image) with use of the second specialized tone curve. As described above, the second specialized tone curve has characteristics suited for improving contrast in a dark non-natural image. In some cases, the display screen of a non-specified app has a background whose keynote color is a dark color (see FIGS. 8 and 10). Using the second specialized tone curve to adjust an input image makes it possible to improve the viewability of such a dark display screen.

In Aspect 4 of the present invention, the display device in accordance with any one of Aspects 1 to 3 may be configured such that: operation modes of the display device include: a normal mode in which the output image is generated without use of the specialized gradation change characteristics to adjust the gradation values of each pixel in the input image; and a specialized mode in which the output image is generated with use of the specialized gradation change characteristics to adjust the gradation values of each pixel of the input image; and the control device is configured such that starting up a predetermined application serves as a trigger for the control device to switch an operation mode of the display device from the normal mode to the specialized mode.

As described above, a natural image generally has a lesser degree of unevenness in the distribution of gradation values thereof, as compared to a non-natural image. As such, in a case where a user is using an app (specified app) suited for viewing natural images, using the specialized tone curve to adjust the input image can conversely lead to a decrease in viewability of the output image (display screen).

To address this problem, the above configuration makes it possible to prevent such a decrease in viewability of a display screen by selectively using the specialized tone curve (switching the operation mode to a specialized mode) in accordance with the type of app being used by the user. For example, it is possible to use the specialized tone curve only in cases where the user is using a non-specified app.

In Aspect 5 of the present invention, the display device in accordance with any one of Aspects 1 to 4 can be configured such that: operation modes of the display device include: a normal mode in which the output image is generated without use of the specialized gradation change characteristics to adjust the gradation values of each pixel in the input image; and a specialized mode in which the output image is generated with use of the specialized gradation change characteristics to adjust the gradation values of each pixel of the input image; the control device is configured to obtain a histogram (HIST) representing a distribution of gradation values of the input image by analyzing the input image; and the control device is configured to select, as an operation mode of the display device, the normal mode or the specialized mode, in accordance with the histogram.

With the above configuration, it is possible to automatically select either the normal mode or the specialized mode in accordance with the distribution of the gradation values of the input image (i.e., in accordance with the brightness of the input image). In other words, it is possible to automatically select a suitable operation mode in accordance with the brightness of the input image, and it is therefore possible to improve user friendliness.

In Aspect 6 of the present invention, the display device of Aspect 5 may be configured such that in the specialized mode, the control device sets, in accordance with the histogram, the gradation change rate of the low-gradation-region side and the high-gradation-region side of the intermediate gradation region in the specialized gradation change characteristic.

With the above configuration, in the specialized mode, it is possible to set the shape of the specialized tone curve in accordance with the distribution of gradation values of the input image (i.e., in accordance with the brightness of the input image). This makes it possible to apply a specialized tone curve which is suited to the input image. For example, in a case where the input image is a bright image, the first specialized tone curve can be set as the specialized tone curve. In a case where the input image is a dark image, the second specialized tone curve can be set as the specialized tone curve.

In Aspect 7 of the present invention, the display device in accordance with any one of Aspects 1 to 6 may be configured such that: operation modes of the display device include: a normal mode in which the output image is generated without use of the specialized gradation change characteristics to adjust the gradation values of each pixel in the input image; and a specialized mode in which the output image is generated with use of the specialized gradation change characteristics to adjust the gradation values of each pixel of the input image; and the display section is configured to be able to display a button (IMGS) for allowing the user to select the operation modes.

With the above configuration, it is possible for the user to select an operation mode of the display device at will. This enables a further increase in user friendliness.

An image processing device (control section 10) in accordance with Aspect 8 of the present invention is an image processing device capable of generating an output image by adjusting an input image, including: an adjustment section (15) configured to generate the output image by adjusting a gradation value of each pixel of the input image with use of specialized gradation change characteristics, wherein assuming that: a gradation value of one pixel of the input image is considered to be an input gradation value; a gradation value of one pixel of the output image, which one pixel corresponds to the one pixel of the input image, is considered to be an output gradation value; in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are: (i) the gradation change rate is substantially constant in the low gradation region and in the high gradation region; (ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

A method of image processing in accordance with Aspect 9 of the present invention is a method of image processing in which an output image is generated by adjustment of an input image, the method including the step of: adjusting a gradation value of each pixel of the input image with use of specialized gradation change characteristics so as to generate the output image, wherein assuming that: a gradation value of one pixel of the input image is considered to be an input gradation value; a gradation value of one pixel of the output image, which one pixel corresponds to the one pixel of the input image, is considered to be an output gradation value; in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are: (i) the gradation change rate is substantially constant in the low gradation region and in the high gradation region; (ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

An image processing device in accordance with the foregoing aspects of the present invention can be realized in the form of a computer. In such a case, the present invention encompasses: a control program for the image processing device which causes a computer to operate as each of the sections (software elements) of the image processing device so that the image processing device can be realized in the form of a computer; and a computer-readable recording medium storing the control program therein.

[Supplemental Remarks]

The present invention is not limited to the foregoing embodiments, but can be altered by a skilled person in the art within the scope of the claims. The present invention also encompasses, in its technical scope, any embodiment derived by combining technical means disclosed in differing embodiments. It is possible to form a new technical feature by combining the technical means disclosed in the respective embodiments.

REFERENCE SIGNS LIST

1, 2 Smartphone (display device)
10, 20 Control section (control device, image processing device)
11 Image analyzing section
12 Tone curve setting section
13 Mode selecting section
14 App executing section
15 Adjustment section
21 Tone curve selecting section
80 TP
81 Input section
82 Display section
x Gradation value of one pixel of input image (input gradation value)

Y Gradation value of one pixel of output image (output gradation value)

V Gradation change rate

CV1 First specialized tone curve (first specialized gradation change characteristics, specialized gradation change characteristics)

CV2 Second specialized tone curve (second specialized gradation change characteristics, specialized gradation change characteristics)

HIST, HIST1 to HIST4 Histogram

IMG1, IMG1A to IMG1D Input image

IMG2, IMG2A to IMG2D Output image

IMGS Button

The invention claimed is:

1. A display device comprising:

a control device capable of generating an output image by adjusting an input image; and a display section configured to display the output image, the control device being capable of generating the output image by adjusting a gradation value of each pixel of the input image with use of specialized gradation change characteristics, wherein assuming that:

a gradation value of one pixel of the input image is considered to be an input gradation value;

a gradation value of one pixel of the output image, which one pixel corresponds to the one pixel of the input image, is considered to be an output gradation value;

in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are:

(i) the gradation change rate is substantially constant in the low gradation region and in the high gradation region;

(ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

2. The display device according to claim 1, wherein:

the specialized gradation change characteristics include first specialized gradation change characteristics, the first specialized gradation change characteristics being:

(i) in the low-gradation-region side of the intermediate gradation region, the gradation change rate is lower than in the low gradation region and lower than in the high gradation region; and (ii) in the high-gradation-region side of the intermediate gradation region, the gradation change rate is higher than in the low gradation region and higher than in the high gradation region.

3. The display device according to claim 1, wherein:

the specialized gradation change characteristics include second specialized gradation change characteristics, the second specialized gradation change characteristic being:

(i) in the low-gradation-region side of the intermediate gradation region, the gradation change rate is higher than in the low gradation region and higher than in the high gradation region; and (ii) in the high-gradation-region side of the intermediate gradation region, the gradation change rate is lower than in the low gradation region and lower than in the high gradation region.

4. The display device according to claim 1, wherein:

operation modes of the display device include:

a normal mode in which the output image is generated without use of the specialized gradation change characteristics to adjust the gradation values of each pixel in the input image; and a specialized mode in which the output image is generated with use of the specialized gradation change characteristics to adjust the gradation values of each pixel of the input image; and the control device is configured such that starting up a predetermined application serves as a trigger for the control device to switch an operation mode of the display device from the normal mode to the specialized mode.

5. The display device according to claim 1, wherein:

operation modes of the display device include:

a normal mode in which the output image is generated without use of the specialized gradation change characteristics to adjust the gradation values of each pixel in the input image; and a specialized mode in which the output image is generated with use of the specialized gradation change characteristics to adjust the gradation values of each pixel of the input image;

the control device is configured to obtain a histogram representing a distribution of gradation values of the input image by analyzing the input image; and the control device is configured to select, as an operation mode of the display device, the normal mode or the specialized mode, in accordance with the histogram.

6. The display device according to claim 5, wherein in the specialized mode, the control device sets, in accordance with the histogram, the gradation change rate of the low-gradation-region side and the high-gradation-region side of the intermediate gradation region in the specialized gradation change characteristic.

7. The display device according to claim 1, wherein:

operation modes of the display device include:

a normal mode in which the output image is generated without use of the specialized gradation change characteristics to adjust the gradation values of each pixel in the input image; and a specialized mode in which the output image is generated with use of the specialized gradation change characteristics to adjust the gradation values of each pixel of the input image; and the display section is configured to be able to display a button for allowing the user to select the operation modes.

8. An image processing device capable of generating an output image by adjusting an input image, comprising:

an adjustment section configured to generate the output image by adjusting a gradation value of each pixel of the input image with use of specialized gradation change characteristics, wherein assuming that:

a gradation value of one pixel of the input image is considered to be an input gradation value;

a gradation value of one pixel of the output image, which one pixel corresponds to the one pixel of the input image, is considered to be an output gradation value;

in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are:

(i) the gradation change rate is substantially constant in the low gradation region and in the high gradation region;

(ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

9. A method of image processing in which an output image is generated by adjustment of an input image, the method comprising the step of:

adjusting a gradation value of each pixel of the input image with use of specialized gradation change characteristics so as to generate the output image, wherein assuming that:

a gradation value of one pixel of the input image is considered to be an input gradation value;

a gradation value of one pixel of the output image, which one pixel corresponds to the one pixel of the input image, is considered to be an output gradation value;

in a gradation change characteristic which indicates a correlation between the input gradation value and the output gradation value, a gradation change rate is defined as being a rate of change of the output gradation value with respect to the input gradation value; and a gradation region representing all possible gradation values of each pixel of the input image is divided into a low gradation region, an intermediate gradation region, and a high gradation region, the specialized gradation change characteristics are:

(i) the gradation change rate is substantially constant in the low gradation region and in the high gradation region;

(ii) in a first side of the intermediate gradation region selected from (a) a low-gradation-region side and (b) a high-gradation-region side, the gradation change rate is lower than in the low gradation region and lower than in the high gradation region; and (iii) in a second side of the intermediate gradation region selected from (a) the low-gradation-region side and (b) the high-gradation-region side, the second side differing from the first side, the gradation change rate is higher than in the low gradation region and higher than in the high gradation region.

* * * * *